US009405268B2

(12) United States Patent
Lee

(10) Patent No.: US 9,405,268 B2
(45) Date of Patent: Aug. 2, 2016

(54) IMAGE FORMING APPARATUS

(71) Applicant: SAMSUNG ELECTRONICS CO., LTD., Suwon-si, Gyeonggi-do (KR)

(72) Inventor: Han Jun Lee, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/816,499

(22) Filed: Aug. 3, 2015

(65) Prior Publication Data

US 2016/0062307 A1 Mar. 3, 2016

(30) Foreign Application Priority Data

Sep. 3, 2014 (KR) ..... 10-2014-0117002

(51) Int. Cl.
*G03G 21/16* (2006.01)

(52) U.S. Cl.
CPC ..... *G03G 21/1676* (2013.01)

(58) Field of Classification Search
CPC combination set(s) only.
See application file for complete search history.

(56) References Cited

U.S. PATENT DOCUMENTS

2007/0071495 A1* 3/2007 Hashimoto ..... G03G 21/1821 399/111

* cited by examiner

*Primary Examiner* — Clayton E Laballe
*Assistant Examiner* — Jas Sanghera
(74) *Attorney, Agent, or Firm* — Staas & Halsey LLP

(57) ABSTRACT

An image forming apparatus may include a pressing assembly provided adjacent to the developing device and configured to restrict a movement of the developing device. The pressing assembly may include a rotating shaft formed to extend in a first direction and an operating unit provided at an end of the rotating shaft to be rotated along with the rotating shaft and configured to restrict the movement of the developing device in the first direction. Due to such a structure, the developing device may come into close contact in the installing direction, and also the developing roller of the developing device and the photoreceptor may come into contact with each other.

37 Claims, 42 Drawing Sheets

IMAGE FORMING APPARATUS

CROSS-REFERENCE TO RELATED APPLICATIONS

This application claims the priority benefit of Korean Patent Application No. 10-2014-0117002, filed on Sep. 3, 2014 in the Korean Intellectual Property Office, the disclosure of which is incorporated herein by reference.

BACKGROUND

1. Field

Embodiments of the disclosure relate to an image forming apparatus, and more particularly, to an image forming apparatus having an improved structure capable of easily installing a developing unit.

2. Description of the Related Art

An image forming apparatus generally refers to an apparatus which forms an image on a print medium according to an input signal, and may be a printer, a copy machine, a fax, and an official replicator in which these functions are integrated.

An electro-photographic image forming apparatus which is one type of image forming apparatus may include a photoreceptor unit having a photoreceptor therein, a charging unit disposed around the photoreceptor unit to charge the photoreceptor with a predetermined electric potential, a developing unit having a developing roller, and an optical scanning unit. The optical scanning unit serves to radiate light to the photoreceptor charged with the predetermined electric potential by the charging unit, and thus to form an electrostatic latent image on a surface of the photoreceptor, and the developing unit serves to supply a photosensitizer to the photoreceptor on which the electrostatic latent image is formed and thus to form a visible image.

In the case of the image forming apparatus having a structure in which the developing roller comes into contact with the photoreceptor so as to supply the photosensitizer, when a printing operation is performed, the developing roller and the photoreceptor should come into contact with each other, and also when the developing unit is replaced, the developing roller and the photoreceptor should be separated from each other to prevent interference between the developing roller and the photoreceptor.

However, the developing unit may be replaced while the developing roller and the photoreceptor come into contact with each other, and thus the developing unit or the photoreceptor may be damaged, or the image forming apparatus may be operated while the developing roller and the photoreceptor are separated from each other, and thus a defective image may be formed.

SUMMARY

Therefore, it is an aspect of the disclosure to provide an image forming apparatus in which a fixing structure of a developing device is improved.

Additional aspects of the disclosure will be set forth in part in the description which follows and, in part, will be apparent from the description, or may be learned by practice of the disclosure.

In accordance with an aspect of the disclosure, an image forming apparatus may include a main body, a developing device formed in a first direction, and including a photoreceptor unit having a photoreceptor, and a developing unit provided adjacent to the photoreceptor and having a developing roller provided to come into contact with or be separated from the photoreceptor, and a pressing assembly provided adjacent to the developing device and configured to restrict a movement of the developing device. The pressing assembly may include a rotating shaft formed to extend in the first direction to be rotatable, and an operating unit provided at an end of the rotating shaft to be rotated along with the rotating shaft and configured to restrict the movement of the developing device in the first direction.

The operating unit may be provided to be rotated between a stand-by position and an operating position in which the operating unit is rotated from the stand-by position and supports an end of the developing device to restrict a movement of the developing device in the first direction.

The operating unit may include an operating body rotatably provided at an end of the rotating shaft, and a pressing member provided at one side of the operating body to press the developing device.

The pressing member may be formed to be more convex than the adjacent operating body.

The first direction may include an installing direction in which the photoreceptor unit is installed at the developing device seating part, and a separating direction which is opposite to the installing direction and in which the photoreceptor unit is separated from the developing device seating part, and the pressing member may include a first pressing part in which the operating unit comes into contact with the developing device while moved from the stand-by position to the operating position, and a second pressing part which extends from the first pressing part so as to more protrude in the installing direction than the first pressing part, the operating unit coming in contact with the developing device at the operating position.

The first direction may include an installing direction in which the photoreceptor unit is installed at the developing device seating part, and a separating direction which is opposite to the installing direction and in which the photoreceptor unit is separated from the developing device seating part, and the photoreceptor unit may include a to-be-pressed surface formed to be inclined, such that the photoreceptor unit is pressed in the installing direction by the operating unit while the operating unit is moved from the stand-by position to the operating position.

A movement of the rotating shaft in the first direction may be restricted by the developing device seating part.

The first direction may include an installing direction in which the photoreceptor unit is installed at the developing device seating part, and a separating direction which is opposite to the installing direction and in which the photoreceptor unit is separated from the developing device seating part, and the operating unit may further include an operation elastic part configured to press the operating body in the installing direction.

The operation elastic part may include a fastening member provided at one end of the rotating shaft to have a component vertical to a rotating axis of the rotating shaft, and an installation elastic member of which one end is supported by the fastening member, and the other end presses the operating unit in the installing direction.

The operating unit may be pressed in the installing direction by the installation elastic member, and a movement of the operating unit in the separating direction may be restricted by the fastening member.

The operating unit may further include an installing space formed at an inner side of the operating body so that the operation elastic part is installed therein, and the installing space may include a first installing space in which the installation elastic member is installed to extend or be compressed, and a second installing space which is formed using a movement restricting surface configured to restrict a movement of the operating unit in the separating direction as a boundary line and in which the fastening member is installed.

The pressing assembly may further include at least one pressing unit configured to press the developing unit so that the developing roller and the photoreceptor come into close contact with each other, and provided to be interlocked with the operating unit.

The operating unit may press the photoreceptor unit in the first direction while moved from the stand-by position to the operating position, and the at least one pressing unit may be interlocked with the movement of the operating unit from the stand-by position to the operating position, and presses the developing unit in a second direction vertical to the first direction.

The at least one pressing unit may include a link unit configured to convert rotating motion of the rotating shaft due to rotation of the operating unit into linear reciprocating motion, and a pressing part connected with the link unit so as to press the developing device.

The link unit may include a first link member rotated along with the rotating shaft, and a second link member of which one end is connected with an end of the first link and the other end linearly reciprocates.

The at least one pressing unit may include a plurality of pressing units disposed at the rotating shaft to be spaced apart from each other.

The link unit may include a pressing elastic member provided at the second link member to generate a pressing force of the pressing unit.

The second link member may include a stopper insertion part of which at least a part is inserted into the pressing part depending on a position of the pressing unit, and a variable seating part which is disposed adjacent to the stopper insertion part, and in which the pressing elastic member is seated thereon, and with which a length of the pressing elastic member is interlocked and varied so that the pressing force of the pressing elastic member is varied.

One end of the pressing elastic member may be supported by an end of the second link member, and the other end thereof may be supported by the pressing part.

The pressing elastic member may be compressed to a maximally compressed length ML, when the operating unit is disposed between the operating position and the stand-by position.

In accordance with an aspect of the disclosure, an image forming apparatus may include a main body, a developing device including a photoreceptor unit having a photoreceptor, and a developing unit provided adjacent to the photoreceptor and having a developing roller provided to come into contact with or be separated from the photoreceptor, and a pressing assembly provided adjacent to the developing device, wherein the pressing assembly may include a pressing unit configured to press the developing unit so that the developing roller and the photoreceptor come into contact with each other, and an operating unit provided to be moved between an operating position in which a pressing force is generated from the pressing unit and a stand-by position in which the pressing force is released, and also to restrict a movement of the developing device.

A first direction may be a lengthwise direction of the developing device, and the operating unit may press the developing device in the first direction, and the pressing unit may press the developing unit in a second direction vertical to the first direction.

A pressing operation of the operating unit in the first direction with respect to the developing device, and a pressing operation of the pressing unit in the second direction with respect to the developing unit may be performed simultaneously.

The operating unit may include an operating body rotatably provided at an end of a rotating shaft, and a pressing member provided at one side of the operating body to press the developing device.

The pressing member may be formed to be more convex than the adjacent operating body.

The first direction may include an installing direction in which the photoreceptor unit is installed at the developing device seating part, and a separating direction which is opposite to the installing direction and in which the photoreceptor unit is separated from the developing device seating part, and the pressing member may include a first pressing part in which the operating unit comes into contact with the developing device while moved from the stand-by position to the operating position, and a second pressing part which extends from the first pressing part so as to more protrude in the installing direction than the first pressing part, the operating unit coming in contact with the developing device at the operating position.

The first direction may include an installing direction in which the photoreceptor unit is installed at the developing device seating part, and a separating direction which is opposite to the installing direction and in which the photoreceptor unit is separated from the developing device seating part, and the photoreceptor unit may include a to-be-pressed surface formed to be inclined, such that the photoreceptor unit is pressed in the installing direction by the operating unit while the operating unit is moved from the stand-by position to the operating position.

The pressing assembly may further include a rotating shaft configured to extend in the first direction so as to transmit an operation of the operating unit to the pressing unit.

A movement of the rotating shaft in the first direction may be restricted by the developing device seating part.

The first direction may include an installing direction in which the photoreceptor unit is installed at the developing device seating part, and a separating direction which is opposite to the installing direction and in which the photoreceptor unit is separated from the developing device seating part, and the operation unit may further include an operating elastic part configured to press the operating body in the installing direction.

The operation elastic part may include a fastening member provided at one end of the rotating shaft to have a component vertical to a rotating axis of the rotating shaft, and an installation elastic member of which one end is supported by the fastening member, and the other end presses the operating unit in the installing direction.

The operating unit may be pressed in the installing direction by the installation elastic member, and a movement of the operating unit in the separating direction may be restricted by the fastening member.

The operating unit may further include an installing space formed at an inner side of the operating body so that the operation elastic part is installed therein, and the installing space may include a first installing space in which the installation elastic member is installed to extend or be compressed, and a second installing space which is formed using a movement restricting surface configured to restrict a movement of the operating unit in the separating direction as a boundary line and in which the fastening member is installed.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Reference will now be made in detail to embodiments of the disclosure, examples of which are illustrated in the accompanying drawings. Embodiments are described below to explain the disclosure by referring to the figures.

An image forming apparatus in accordance with an embodiment of the disclosure will be described.

Figure 1:
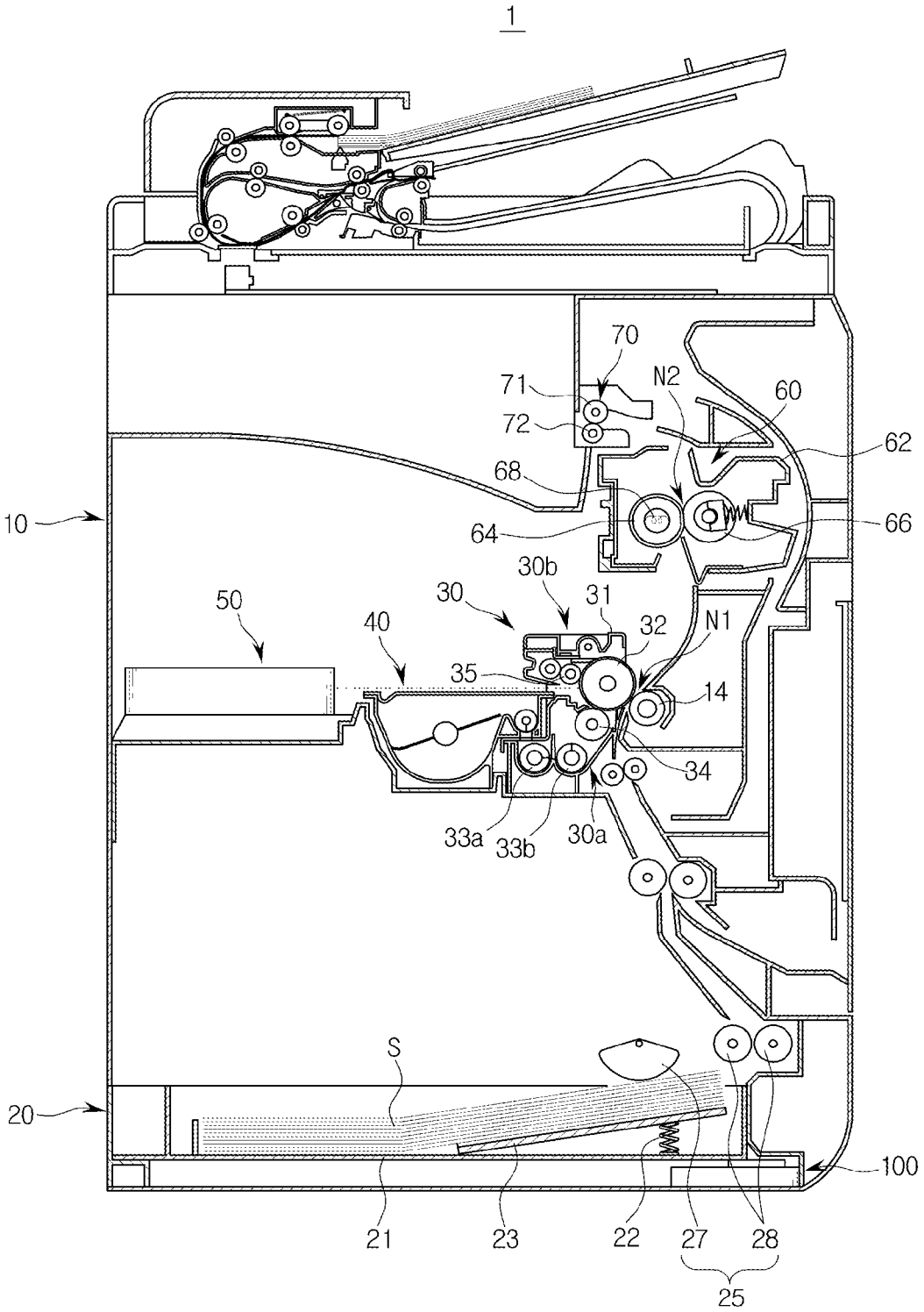
FIG. 1 is a cross-sectional view of an image forming apparatus in accordance with an embodiment of the disclosure.

FIG. 1 is a cross-sectional view of the image forming apparatus in accordance with an embodiment of the disclosure.

As illustrated in FIG. 1, the image forming apparatus 1 may include a main body 10, a print medium supplying device 20 which stores and feeds a print medium S, a developing device 30 which forms an image on the print medium S supplied through the print medium supplying device 20, a toner device 40 which supplies toner to the developing device 30, an optical scanning device 50 which forms an electrostatic latent image on a photoreceptor 32 of the developing device 30, a fixing device 60 which fixes a toner image transferred on the print medium S to the print medium S, and a discharging device 70 which discharges the print medium S on which an image forming is completed.

The print medium supplying device 20 which stores and feeds the print medium S is provided at a lower portion of the main body 10 to supply the print medium S toward the developing device 30.

The print medium supplying device 20 may include a print medium cassette 21 which is coupled to the main body 10 to be opened and closed and thus to store the print medium S, and a transporting member 25 which picks up each sheet of the print medium S stored in the print medium cassette 21 and transports it toward the developing device 30.

One end of the print medium cassette 21 may be rotatably coupled so as to guide the print medium S stored therein toward the transporting member 25, and the other end thereof may have a knock-up plate 23 supported by a pressing spring 22.

The transporting member 25 may include a pick-up roller 27 which picks up each sheet of the print medium S loaded on the knock-up plate 23, and a feed roller 28 which transports the print medium S picked up by the pick-up roller 27 toward the developing device 30.

The developing device 30 may include a housing 31 which defines an exterior thereof, the photoreceptor 32 which is rotatably coupled in the housing 31 to form the electrostatic latent image, stirring screws 33*a* and 33*b* which stir the toner supplied from the toner device 40, a developing roller 34 which supplies the toner stirred by the stirring screws 33*a* and 33*b* to the photoreceptor 32, and a charging member 35 which charges the photoreceptor 32.

The toner supplied from the toner device 40 is introduced into the housing 31, and then stirred and transported to one side of the housing 31 by the stirring screws 33*a* and 33*b*. The stirred and transported toner may be supplied to the photoreceptor 32 by the developing roller 34 so as to form the visible image.

The photoreceptor 32 comes into contact with a transfer roller 14 so as to form a transfer nip N1, such that the toner supplied to the photoreceptor 32 and forming the visible image is transferred on the print medium S. The transfer roller 14 may be rotatably disposed in the main body 10.

The toner device 40 may be coupled with the developing device 30 so as to receive and store the toner which forms an image on the print medium S and also to supply the toner to the developing device 30 when the image forming operation is performed.

The optical scanning device 50 radiates light including image information onto the photoreceptor 32 so as to form the electrostatic latent image on the photoreceptor 32.

The fixing device 60 may include a housing 62, a heating member 64, and a pressing member 66 which are rotatably disposed in the housing 62.

The print medium S on which the toner image is transferred passes between the heating member 64 and the pressing member 66. At this time, the toner image is fixed to the print medium S by heat and pressure.

The heating member 64 is rotated while engaged with the pressing member 66, forms a fixing nip N2 with the pressing member 66, and heated by a heating source 68 so as to transfer heat to the print medium S passing through the fixing nip N2. The heating member 64 may be a heating roller which receives power from a driving source (not shown) so as to be rotated. The heating source 68 which applies the heat to the print medium S on which the toner is transferred may be disposed at an inner side of the heating member 64. A halogen lamp may be used as the heating source 68. However, an electro-thermal wire, an induction heater, or the like may be also used as the heating source 68.

The pressing member 66 may be disposed to come into contact with an outer circumferential surface of the heating member 64, such that the fixing nip N2 is formed between the pressing member 66 and the heating member 64. The heating member 64 may be a pressing roller which receives power from a driving source (not shown) to be rotated.

The discharging device 70 may include a first discharging roller 71 and a second discharging roller 72 which are engaged with each other so as to discharge the print medium S passing through the fixing device 60 to an outside of the main body 10.

Figure 2:
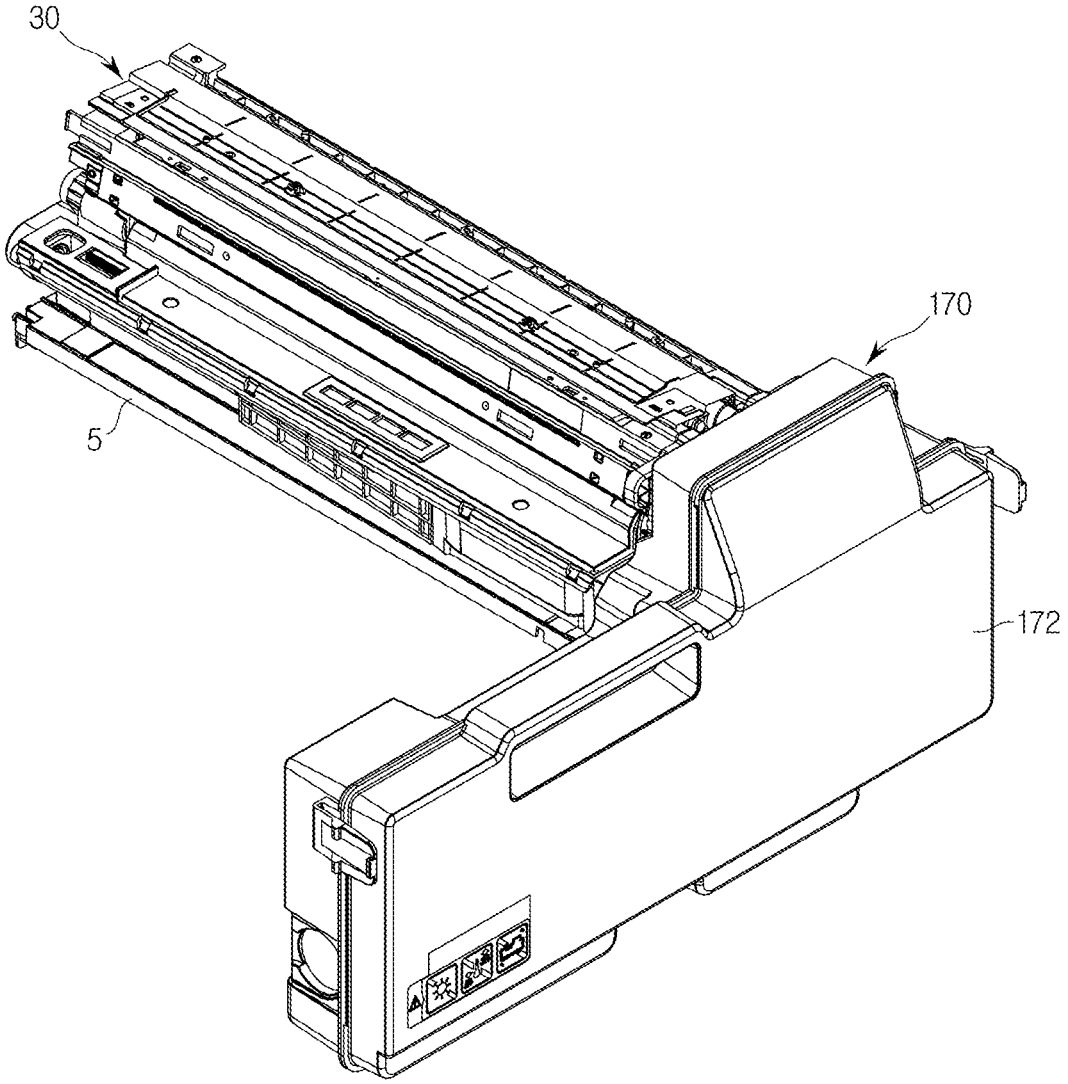
FIG. 2 is a view illustrating a developing device and a cover unit of the image forming apparatus in accordance with an embodiment of the disclosure.
Figure 3:
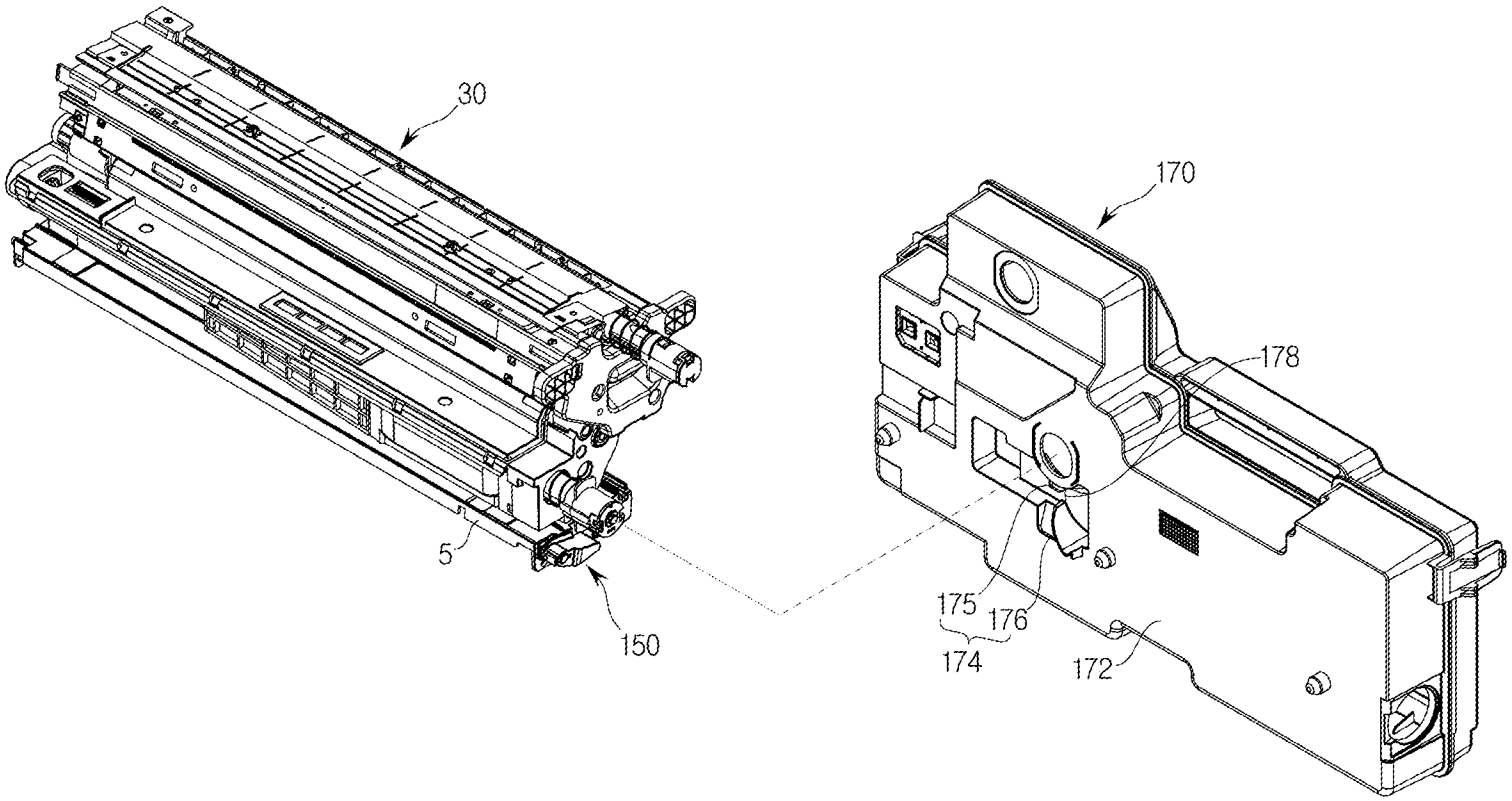
FIG. 3 is a view illustrating a coupling of the developing device and the cover unit of the image forming apparatus in accordance with an embodiment of the disclosure.

FIG. 2 is a view illustrating the developing device and a cover unit of the image forming apparatus in accordance with an embodiment of the disclosure, and FIG. 3 is a view illustrating a coupling of the developing device and the cover unit of the image forming apparatus in accordance with an embodiment of the disclosure.

The developing device 30 may be provided to be seated on a developing device seating part 5. A waste toner storing unit in which waste toner generated from the developing device 30 is stored may be provided at one side of the developing device 30. The toner used in the developing device 30 may be moved to the waste toner storing unit and then stored in the waste toner storing unit. In an embodiment of the disclosure, the waste toner storing unit may be referred to as a cover unit 170.

A pressing assembly 100 (see FIGS. 6A to 7C) may be provided at one side of the developing device 30 so that a developing unit 30*a* and a photoreceptor unit 30*b* come into close contact with each other. Specifically, the developing roller 34 of the developing unit 30*a* and the photoreceptor 32 of the photoreceptor unit 30*b* may be provided to come into close contact with or separated from each other by an operation of the pressing assembly 100.

A guide rib 174 which guides the operation of the pressing assembly 100 may be provided at the cover unit 170.

The relationship between the pressing assembly 100 and the guide rib 174 and the structures thereof will be described below.

Figure 4A:
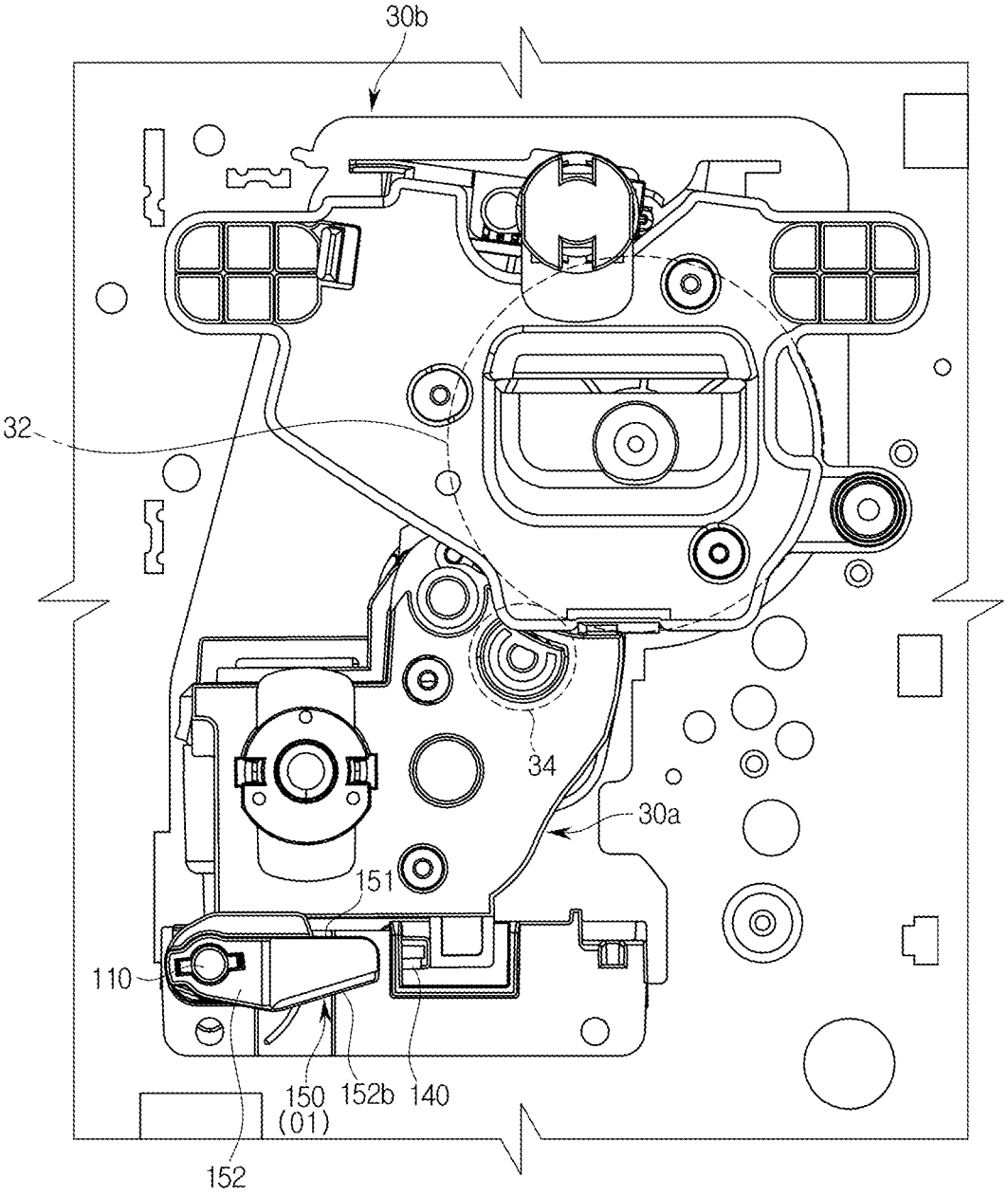
FIGS. 4A and 4B are views respectively illustrating an operation of a pressing assembly and a developing unit in accordance with an embodiment of the disclosure.
Figure 4B:
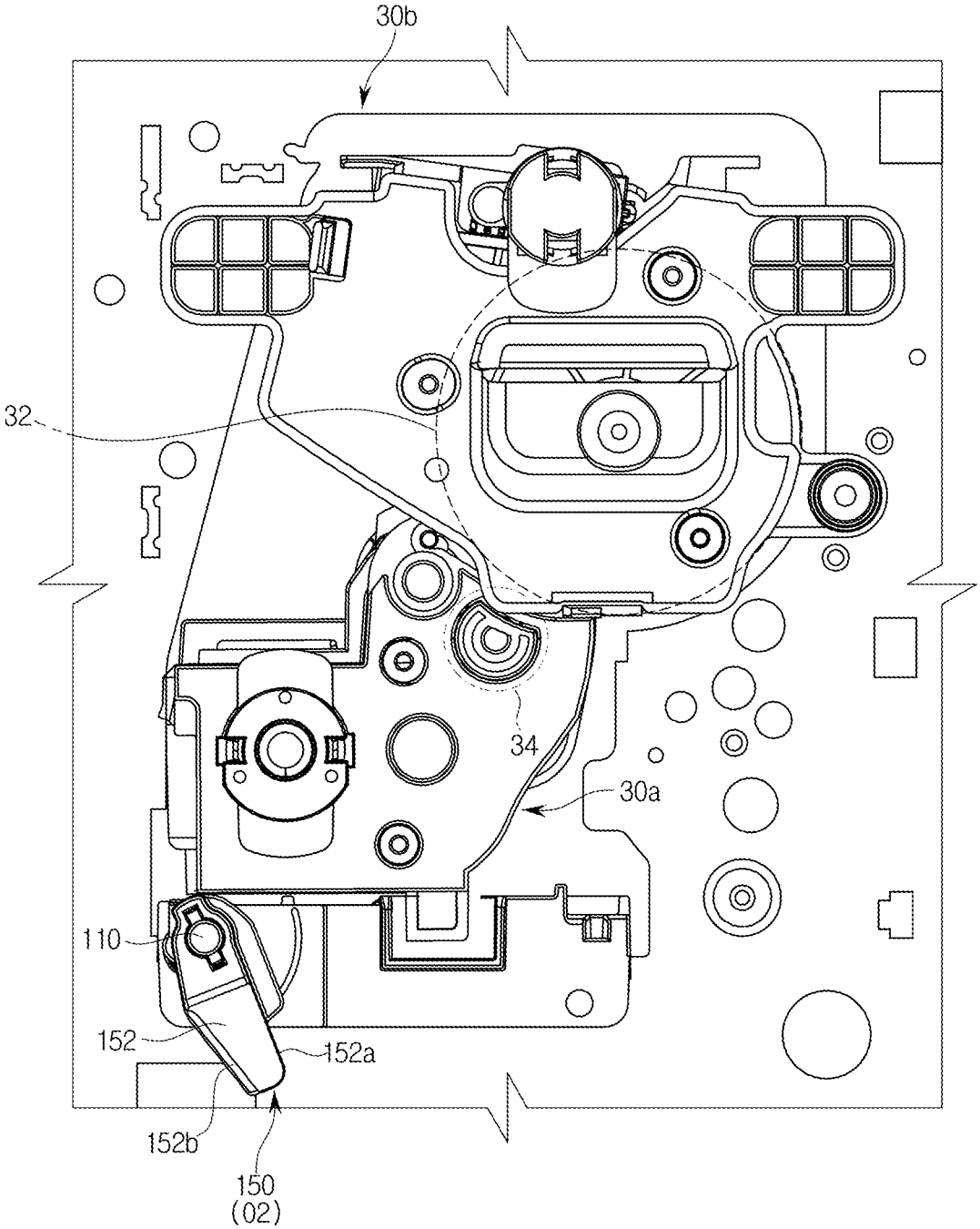
Figure 5A:
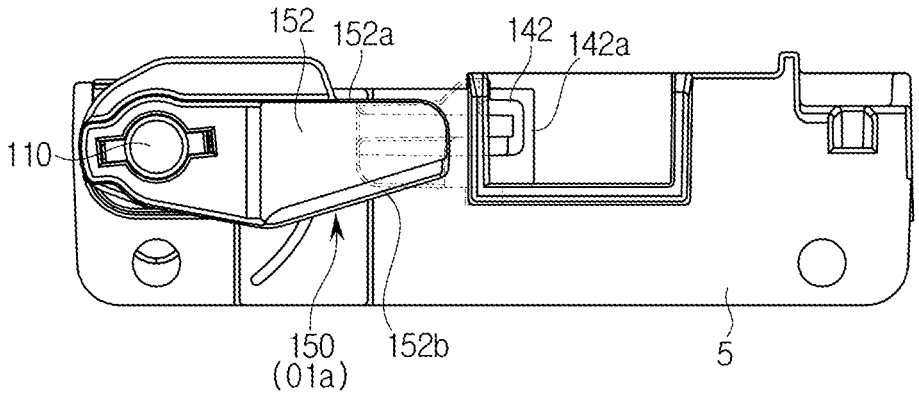
FIGS. 5A, 5B, and 5C are views illustrating the operation of the pressing assembly in accordance with an embodiment of the disclosure.
Figure 5B:
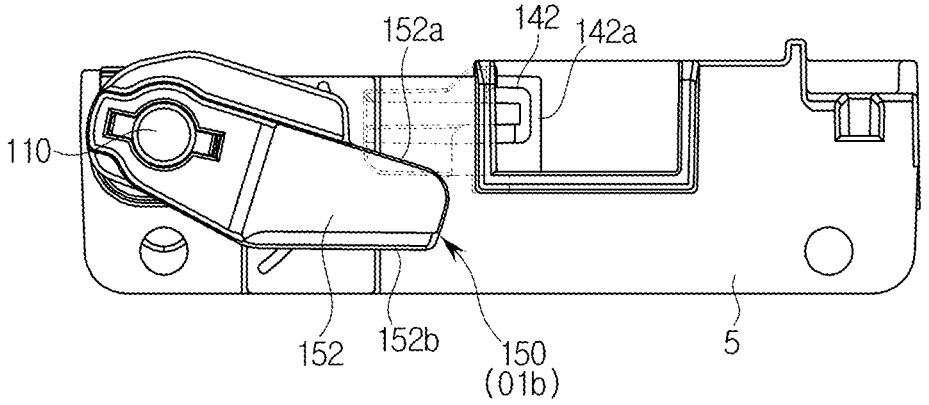
Figure 5C:
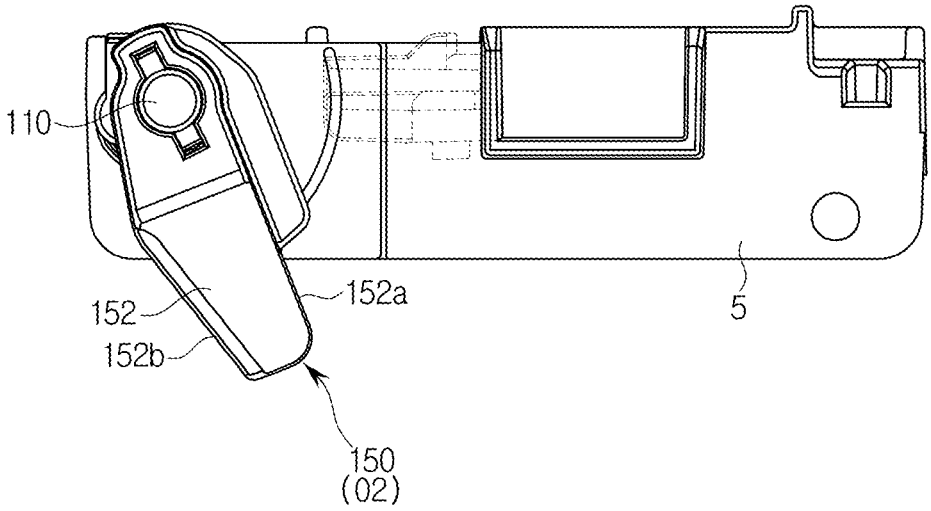
Figure 6A:
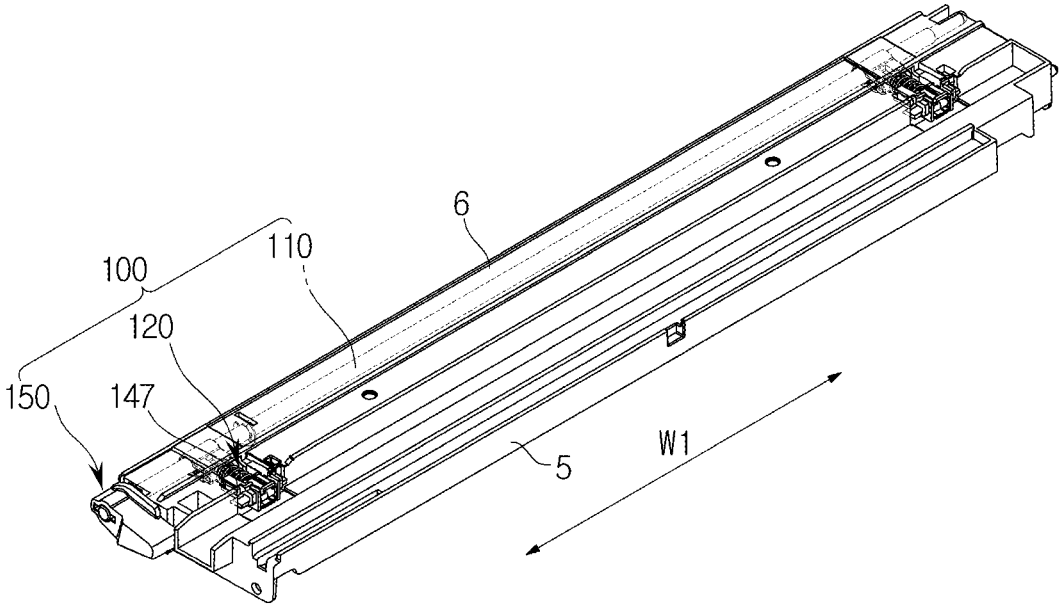
FIGS. 6A and 6B are views illustrating the pressing assembly in accordance with an embodiment of the disclosure.
Figure 6B:
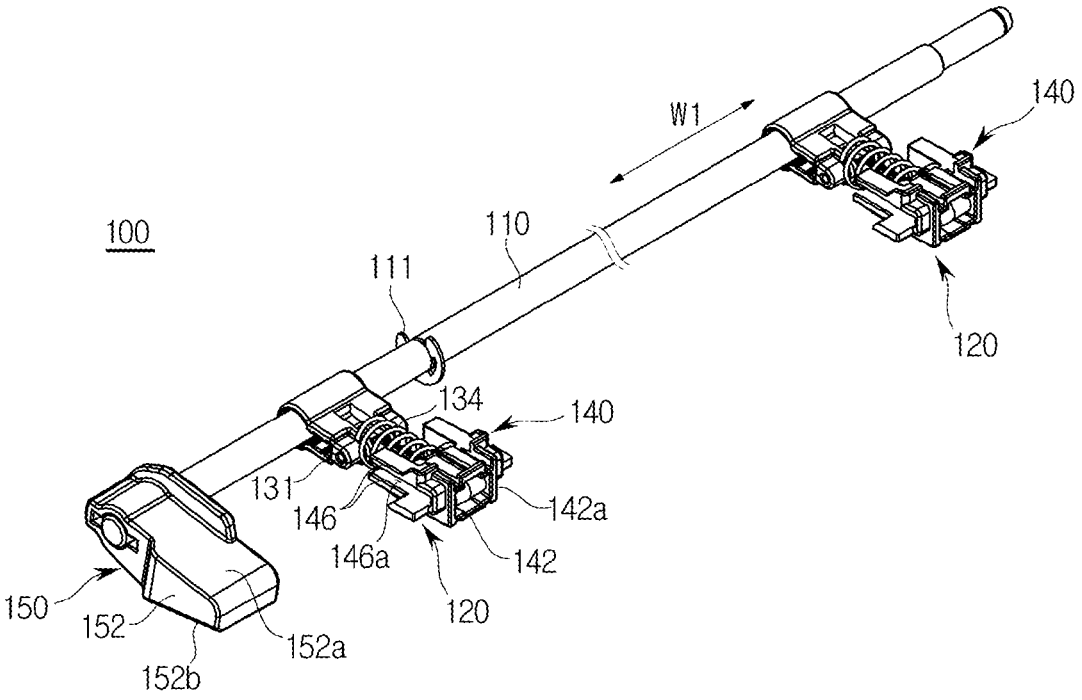
Figure 7A:
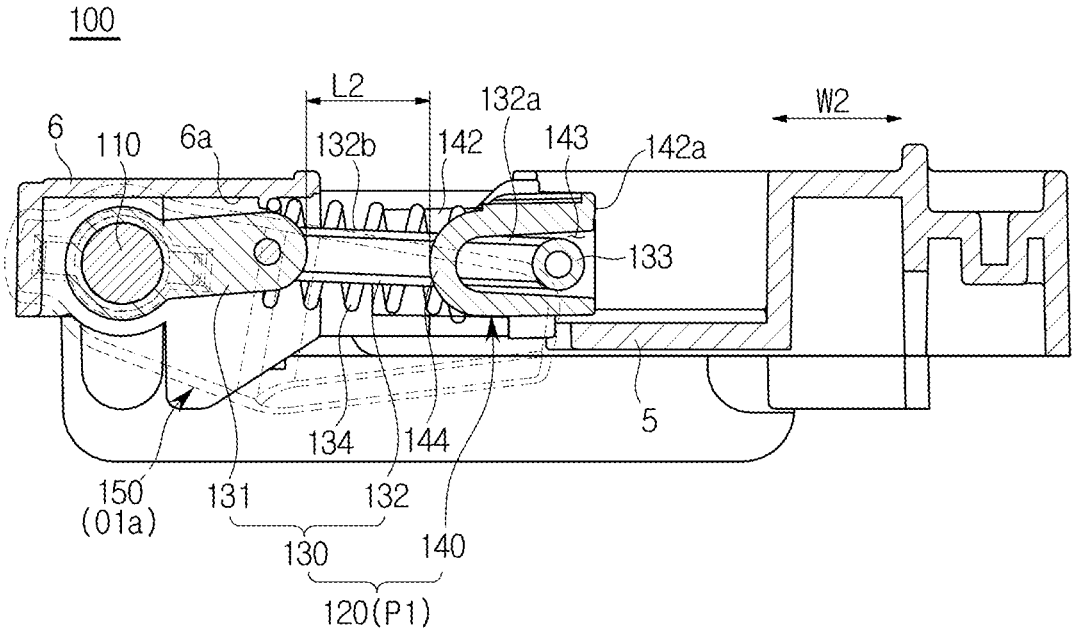
FIGS. 7A, 7B, and 7C are cross-sectional views of a pressing unit depending on the operation of the pressing assembly in accordance with an embodiment of the disclosure.
Figure 7B:
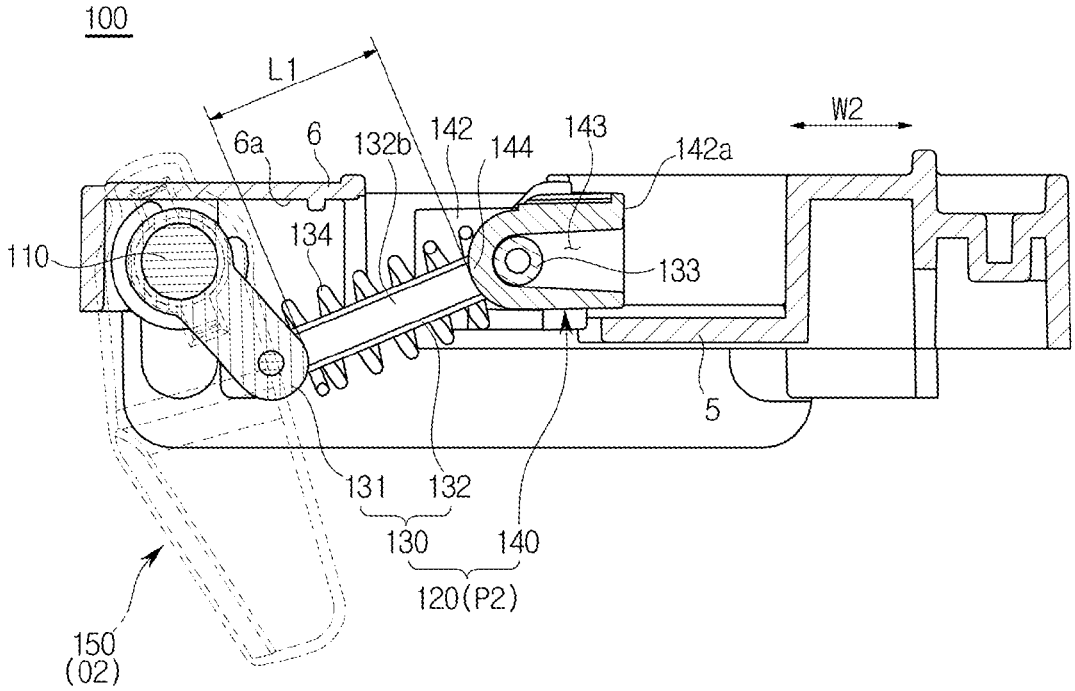
Figure 7C:
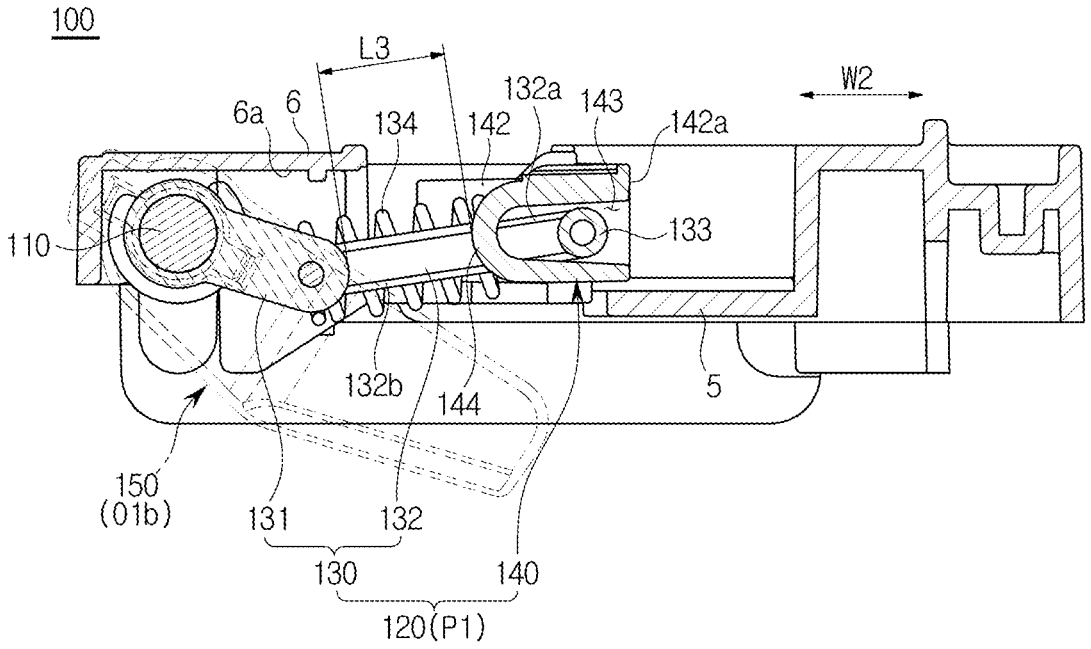

FIGS. 4A and 4B are views respectively illustrating the operation of the pressing assembly and the developing unit in accordance with an embodiment of the disclosure, FIGS. 5A, 5B, and 5C are views illustrating the operation of the pressing assembly in accordance with an embodiment of the disclosure, FIGS. 6A and 6B are views illustrating the pressing assembly in accordance with an embodiment of the disclosure, and FIGS. 7A, 7B, and 7C are cross-sectional views of the pressing unit depending on the operation of the pressing assembly in accordance with an embodiment of the disclosure.

The pressing assembly 100 is disposed adjacent to the developing device 30, such that the developing unit 30*a* and the photoreceptor unit 30*b* come into close contact with or are separated from each other. Specifically, the pressing assembly 100 is provided so that the developing roller 34 of the developing unit 30*a* and the photoreceptor 32 of the photoreceptor unit 30*b* come into close contact with or are separated from each other. An arrangement of the pressing assembly 100 is not limited. However, in the embodiment of the disclosure, the pressing assembly 100 is disposed at the developing device seating part 5.

The pressing assembly 100 may include a rotating shaft 110, a pressing unit 120, and an operating unit 150.

The rotating shaft 110 may be rotatably provided so that an operation of the operating unit 150 is transmitted to the pressing unit 120. Assuming that a lengthwise direction of the developing device 30, the developing unit 30*a*, and the photoreceptor unit 30*b* is a first direction W1, the rotating shaft 110 may be formed to be elongated in the first direction W1. The first direction W1 may be defined as a direction vertical or perpendicular (substantially vertical or perpendicular) to a moving direction of the print medium. The rotating shaft 110 may serve as a rotating center of the operating unit 150 to be described below.

The rotating shaft 110 may be disposed in the first direction W1, and may be provided so that a movement thereof in the first direction W1 is restricted. The rotating shaft 110 may be provided to be rotatable about a rotating axis. At least one shaft stopper 111 may be provided at an outer circumferential surface of the rotating shaft 110 so that the movement of the rotating shaft 110 in the first direction W1 is restricted.

The pressing unit 120 is provided so that the developing roller 34 and the photoreceptor 32 come into close contact with each other. Specifically, the pressing unit 120 is provided so as to press the developing unit 30*a*, such that the developing roller 34 and the photoreceptor 32 come into close contact with or are separated from each other. The pressing unit 120 may be disposed on the rotating shaft 110, and may be provided to receive the operation of the operating unit 150 through the rotating shaft 110 and thus to be operated.

The pressing unit 120 may be provided to be interlocked with the operating unit 150. At least one pressing unit 120 may be provided. By such a structure, at least one pressing unit 120 may be provided to be interlocked with the operating unit 150. In the case in which a plurality of pressing units 120 are provided, the plurality of pressing units 120 may be disposed on the rotating shaft 110 to be spaced apart from each other. As an example, the plurality of pressing units 120 may be disposed on the rotating shaft 110 to be spaced apart at regular intervals from each other, such that the same pressing force is distributed in the first direction W1, and thus the developing unit 30*a* is pressed by an uniform pressing force, regardless of a position in a lengthwise direction thereof.

The pressing unit 120 may be provided to be moved between a pressing position P1 (see, e.g., FIG. 4A and FIG. 7A) in which the developing roller 34 and the photoreceptor 32 come into contact with each other, and a releasing position P2 (see, e.g., FIG. 4B and FIG. 7B) which is moved back from the pressing position P1 so that the developing roller 34 and the photoreceptor 32 are separated from each other. Specifically, when the pressing unit 120 is located at the pressing position P1, the developing unit 30*a* is pressed by the pressing unit 120, and thus the developing roller 34 and the photoreceptor 32 come into contact with each other. Also, when the pressing unit 120 is located at the releasing position P2, the pressing of the pressing unit 120 with respect to the developing unit 30*a* is released, and thus the developing roller 34 and the photoreceptor 32 are separated from each other.

The operating unit 150 may be rotatably provided so that the pressing unit 120 is operated by the operation of the operating unit 150. That is, at least one pressing unit 120 is provided to be interlocked with the operating unit 150.

The operating unit 150 may include an operating body 152 which is connected with the rotating shaft 110 so as to be rotated about the rotating shaft 110.

The operating unit 150 may be provided to be movable between an operating position 01 in which a pressing force is generated from the pressing unit 120 and a stand-by position 02 in which the pressing force is released.

When the operating unit 150 is located at the operating position 01, the pressing unit 120 presses the developing unit, and when the operating unit 150 is located at the stand-by position 02, the pressing of the pressing unit 120 with respect to the developing unit 30*a* is released.

The operating position 01 of the operating unit 150 may include a fixed operating position 01*a* and a movable operating position 01*b*.

In the fixed operating position 01*a*, the pressing unit 120 may be continuously located at the pressing position P1, and in the movable operating position 01*b*, the pressing unit 120 may be movably located at the pressing position P1. In the fixed operating position 01*a*, the operating unit 150 may be moved to the movable operating position 01*b* or the stand-by position 02, only when an external force is applied. In the movable operating position 01*b*, the operating unit 150 may be moved to the stand-by position 02 without the external force.

When the operating unit 150 is located at the fixed operating position 01*a* and the movable operating position 01*b*, the pressing force generated at the pressing unit 120 interlocked with the operating unit 150 may be the same.

The pressing unit 120 may include a link unit 130 and a pressing part 140.

The link unit 130 serves to convert rotating motion of the rotating shaft 110 generated by the operation of the operating unit 150 into linear motion.

The link unit 130 may include a first link member 131 and a second link member 132.

One end of the first link member 131 is coupled to the rotating shaft 110 so as to be rotated along with rotation of the rotating shaft 110. Due to such a structure, a rotating center of the first link member 131 is provided to coincide with that of the rotating shaft 110.

At least a part of the link unit 130 is disposed at an inner side of the developing device seating part 5 so that rotation of the first link member 131 is partly limited by an inner wall of the developing device seating part 5. This will be described below in detail.

One end of the second link member 132 is connected with an end of the first link member 131, and the other end thereof is provided to linearly reciprocate.

The pressing part 140 is provided at the other end of the second link member 132 so as to reciprocate depending on the linear reciprocating motion of the other end of the second link member 132.

Rotation of the operating unit 150 is transmitted to the first link member 131 by the rotating shaft 110, and the rotation of the first link member 131 is converted into the linear reciprocating motion of the other end of the second link member 132. The pressing part 140 presses the developing unit 30*a*, while reciprocating linearly through the motion of the other end of the second link member 132, and thus the developing roller 34 and the photoreceptor 32 may come into contact with each other.

The link unit 130 may include a pressing elastic member 134.

The pressing elastic member 134 may be provided to generate an elastic force depending on the motion of the pressing unit 120. That is, the pressing elastic member 134 may be provided to extend or be compressed depending on the motion of the pressing unit 120, and thus to provide the elastic force to the pressing unit 120.

The pressing elastic member 134 may be disposed to have a component in a direction opposite to a rotating direction of the rotating shaft 110. That is, the pressing elastic member 134 may be provided to apply an elastic force that has a component of direction opposite to a moving direction of one end of the first link member 131 when the first link member 131 is rotated by the rotation of the rotating shaft 110.

The pressing part 140 may include a pressing body 142 and a pressing movement rail 146.

A pressing surface 142*a* may be provided at a front portion of the pressing body 142. The pressing surface 142*a* may be provided to come into direct contact with the developing unit 30*a* and thus to press the developing unit 30*a*.

The pressing body 142 may be provided at an end of the second link member 132 so as to be interlocked with an operation of the second link member 132.

Specifically, a stopper pin 133 which is formed perpendicular to a lengthwise direction of the second link member 132 may be provided at the end of the second link member 132. A stopper moving part 143 through which the stopper pin 133 is moved may be formed at the pressing body 142.

The pressing part 140 may include a stopper rib 144 which is provided to limit a movement of the stopper pin 133 in the stopper moving part 143. The stopper rib 144 may be provided on the pressing body 142. The stopper rib 144 may be provided to catch the stopper pin 133, when the pressing unit 120 is moved back from the pressing position P1 to the stand-by position 02. Due to such a structure, when the pressing unit 120 is moved from the stand-by position 02 to the pressing position P1, the second link member 132 does not affect the pressing part 140, but when the pressing unit 120 is moved back from the pressing position P1 to the stand-by position 02, the stopper pin 133 of the second link member 132 is caught by the stopper rib 144, and thus the pressing part 140 is moved back.

The second link member 132 may include a stopper insertion part 132*a* and a variable seating part 132*b*.

The stopper insertion part 132*a* of the second link member 132 is a part which is inserted into the stopper moving part 143 of the pressing part 140 by the operation of the pressing unit 120.

The variable seating part 132*b* of the second link member 132 is provided so that the pressing elastic member 134 is seated thereon. The variable seating part 132*b* refers to the remaining parts of the second link member 132, except the stopper insertion part 132*a*. That is, the variable seating part 132*b* may be the parts of the second link member 132, which are formed between one surface of the stopper rib 144 and the end of the second link member 132.

A length of the second link member 132 may be formed to be the same as a sum of a length of the variable seating part 132*b* and a length of the stopper insertion part 132*a*. The lengths of the variable seating part 132*b* and the stopper insertion part 132*a* may be changed depending on the operation of the pressing unit 120, and may be provided so that the sum of the lengths of the variable seating part 132*b* and the stopper insertion part 132*a* is the same as the length of the second link member 132.

Since the length of the variable seating part 132*b* is changed depending on the operation of the pressing unit 120, a length of the pressing elastic member 134 provided at the variable seating part 132*b* is also changed. That is, since the length of the variable seating part 132*b* is changed depending on the operation of the pressing unit 120, the length of the pressing elastic member 134 is also changed depending on the operation of the pressing unit 120. Since a change in the length of the pressing elastic member 134 means a change in the elastic force, the elastic force of the pressing elastic member 134 is changed depending on the operation of the pressing unit 120.

Due to such a structure, when the pressing unit 120 is moved from the stand-by position 02 to the pressing position P1, the length of the variable seating part 132*b* is reduced, and thus the elastic force of the pressing elastic member 134 provided at the variable seating part 132*b* is applied to one surface of the stopper rib 144 of the pressing body 142, and the pressing part 140 is moved in a direction in which the pressing part 140 presses the developing unit 30*a*. Contrarily, when the pressing unit 120 is moved from the pressing position P1 to the stand-by position 02, the length of the variable seating part 132*b* is increased, and thus the elastic force of the pressing elastic member 134 provided at the variable seating part 132*b* is also reduced, and the pressing part 140 is moved back in a direction opposite to the direction in which the pressing part 140 presses the developing unit 30*a*, while the stopper pin 133 of the second link member 132 is caught by the stopper rib 144.

The pressing movement rail 146 is provided at the pressing body 142 so that the pressing part 140 reciprocates linearly. Specifically, a moving protrusion 147 is provided at the developing device seating part 5 to correspond to the pressing movement rail 146, and the pressing movement rail 146 is provided to be moved along the moving protrusion 147.

One pair of pressing movement rails 146 is provided up and down at both side surfaces of the pressing body 142, respectively, such that the moving protrusion 147 is inserted therebetween. A protrusion insertion part 146*a* may be formed between one pair of pressing movement rails 146 so that the moving protrusion 147 is inserted therein.

The rotating motions of the operating unit 150 and the rotating shaft 110 are transmitted to the pressing part 140 by the first and second link members 131 and 132, and converted into the linear reciprocating motion at the pressing part 140 by the pressing movement rail 146 and the moving protrusion 147.

The pressing elastic member 134 may be provided so that a compressed length thereof differs according to a state of the operating unit 150. As described above, this is because the length of the variable seating part 132*b* is changed depending on the operation of the pressing unit 120, and thus the length of the pressing elastic member 134 provided at the variable seating part 132*b* differs.

Specifically, when the operating unit 150 may be at the stand-by position 02, the length of the pressing elastic member 134 is a first length L1, and when the operating unit 150 is at the fixed operating position 01*a*, the length of the pressing elastic member 134 may be a second length L2, and when the operating unit 150 is at the movable operating position 01*b*, the length of the pressing elastic member 134 may be a third length L3.

When the pressing elastic member 134 has the first length L1, the pressing elastic member 134 may be in a state which does not extend or is not compressed. When the pressing elastic member 134 has the second length L2 and the third length L3, the pressing elastic member 134 may be in a state which is compressed so that the elastic force is applied to the pressing elastic member 134. That is, the second length L2 and the third length L3 are provided to be shorter than the first length L1.

The second length L2 and the third length L3 may be the same so that a pressing force generated when the operating unit 150 is at the fixed operating position 01*a* is the same as that generated when the operating unit 150 is at the movable operating position 01*b*.

The pressing elastic member 134 may be provided to be maximally compressed, when the operating unit 150 is located between the fixed operating position 01*a* and the movable operating position 01*b*. That is, the pressing elastic member 134 is compressed to have a maximum compressed length ML, when the operating unit 150 is moved between the fixed operating position 01*a* and the movable operating position 01*b*.

Therefore, in order to move the operating unit 150 from the fixed operating position 01*a* to the movable operating position 01*b* or the stand-by position 02, an external force by which the pressing elastic member 134 is compressed from the second length L2 to a maximally compressed length ML should be applied. Also, the movement of the operating unit 150 from the movable operating position 01*b* to the stand-by position 02 may be performed without the external force by which the pressing elastic member 134 is compressed to the maximally compressed length ML, while the pressing elastic member 134 is elastically returned from the third length L3 to the first length L1.

An operation restricting surface 6*a* may be provided above the link unit 130 so as to restrict an operation of the link unit 130. The operation restricting surface 6*a* may be provided at the developing device seating part 5 to face an upper portion of the link unit 130. Specifically, the developing device seating part 5 may include an assembly cover 6 which covers at least a part of the pressing assembly 100. The rotating shaft 110 and at least a part of the pressing unit 120 may be disposed at an inner side of the assembly cover 6. The operation restricting surface 6*a* which faces the link unit 130 may be provided at the inner side of the assembly cover 6, and the operation of the link unit 130 is partly restricted by the operation restricting surface 6*a*.

This will be described with the operating unit 150.

When the operating unit 150 is at the fixed operating position 01*a*, the end of the first link member 131 of the link unit 130 is in a state in which rotation thereof in one direction is restricted by the operation restricting surface 6*a*. At this time, since a compressed elastic force of the pressing elastic member 134 provided at the second link member 132 is applied in the other direction, the operating unit 150 may be fixed at the fixed operating position 01*a*.

Figure 8A:
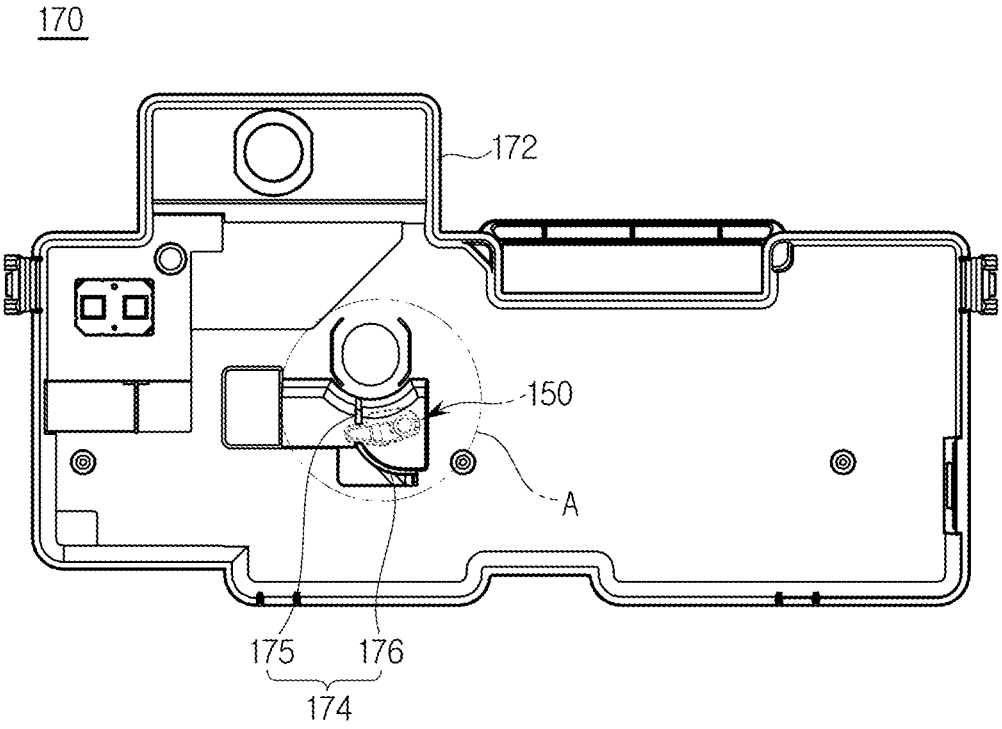
FIG. 8A is a view illustrating the cover unit in accordance with an embodiment of the disclosure.
Figure 8B:
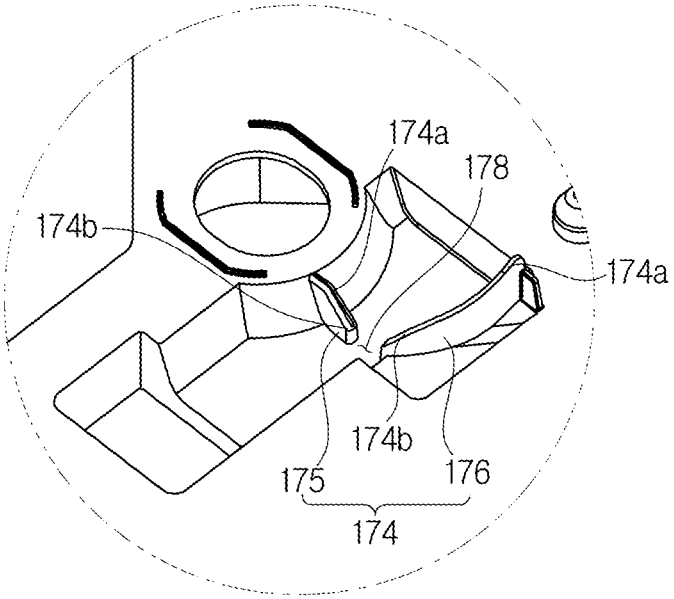
FIG. 8B is an enlarged view of a portion A of FIG. 8A.

FIG. 8A is a view illustrating the cover unit in accordance with an embodiment of the disclosure, and FIG. 8B is an enlarged view of a portion A of FIG. 8A.

The cover unit 170 may be detachably provided at one side of the developing device 30. The cover unit 170 may be provided so that the operation of the operating unit 150 is interlocked with an attachment and detachment thereof. Specifically, while the cover unit 170 is installed at the one side of the developing device 30, the cover unit 170 may guide the operating unit 150 located at the stand-by position 02 or the fixed operating position 01*a* to the movable operating position 01*b*.

The cover unit 170 may include a cover body 172 and a guide rib 174.

The cover body 172 may be provided to cover one side of the developing device 30, and may be connected with the developing device 30 so that the waste toner generated from the developing device 30 is stored therein.

The guide rib 174 may be provided at one surface of the cover body 172, which faces the developing device 30, so as to guide the rotation of the operating unit 150.

The guide rib 174 may include a first guide rib 175 and a second guide rib 176. The first guide rib 175 serves to guide the operating unit 150 which is moved from the fixed operating position 01*a* to the movable operating position 01*b*, and the second guide rib 176 serves to guide the operating unit 150 which is moved from the stand-by position 02 to the movable operating position 01*b*.

The cover unit 170 may include an operating unit seating part 178. The operating unit seating part 178 may be provided at an end of the guide rib 174 so as to locate the operating unit 150 at the movable operating position 01*b* when the cover unit 170 is installed at the one side of the developing device 30. In an embodiment, the operating unit seating part 178 may be provided between the first guide rib 175 and the second guide rib 176, and the operating unit 150 may be guided from the fixed operating position 01*a* or the stand-by position 02 by the guide rib 174 so as to be located at the movable operating position 01*b* corresponding to the operating unit seating part 178.

The guide rib 174 may be formed so that an end thereof is inclined toward the operating unit seating part 178. Due to such a structure, when the cover unit 170 is coupled to the one side of the developing device 30, the operating unit 150 may be rotated and seated on the operating unit seating part 178 corresponding to the movable operating position 01*b*.

Specifically, the guide rib 174 may include a first rib contact part 174*a*, and a second rib contact part 174*b* which is spaced apart a predetermined angle from the first rib contact part 174*a* with respect to the rotating center of the operating unit 150 and extends from the first rib contact part 174*a* so as to have a slope inclined toward the cover body 172.

The operating unit 150 may include an operating body 152, and a first guide surface 152*a* and a second guide surface 152*b* which are provided at the operating body 152.

The first guide surface 152*a* may be provided to be guided by the first guide rib 175, and may be provided at an upper portion of the operating body 152. Specifically, the first guide surface 152*a* may be provided at an upper edge of the operating body 152 so as to be guided from the first rib contact part 174*a* of the first guide rib 175 to the second rib contact part 174*b* thereof.

The second guide surface 152*b* may be provided to be guided by the second guide rib 176, and may be provided at a lower portion of the operating body 152. Specifically, the second guide surface 152*b* may be provided at a lower edge of the operating body 152 so as to be guided from the first rib contact part 174*a* of the second guide rib 176 to the second rib contact part 174*b* thereof.

Hereinafter, an operation of the image forming apparatus in accordance with an embodiment of the disclosure will be described.

To perform a printing operation after the developing device 30 is seated on the developing device seating part 5, the developing unit 30*a* and the photoreceptor unit 30*b* should come into close contact with each other so that the developing roller 34 and the photoreceptor 32 come into contact with each other.

The pressing assembly 100 is operated so that the developing unit 30*a* and the photoreceptor unit 30*b* should come into close contact with each other.

In the initial stage, the operating unit 150 is at the stand-by position 02, and when the developing device 30 is seated on the developing device seating part 5, the operating unit 150 is rotated so that the pressing unit 120 presses the developing unit 30*a*.

When the operating unit 150 is rotated from the stand-by position 02 to the fixed operating position 01*a* or the movable operating position 01*b*, the link unit 130 of the pressing unit 120 is operated, and the pressing part 140 presses the developing unit 30*a*. The pressed developing unit 30*a* comes into close contact with the photoreceptor unit 30*b*, and the developing roller 34 and the photoreceptor 32 come into contact with each other.

As described above, the operating unit 150 may be arbitrarily moved from the stand-by position 02 to the fixed operating position 01*a* or the movable operating position 01*b* so that the developing unit 30*a* and the photoreceptor unit 30*b* should come into close contact with each other. By installing the cover unit 170 at the one side of the developing device 30, the operating unit 150 may be provided to be moved to the operating position 01.

When the cover unit 170 is installed at the one side of the developing device 30, the operating unit 150 is moved to the movable operating position 01*b*, regardless of the position of the operating unit 150.

Specifically, in the case in which the operating unit 150 is at the fixed operating position 01*a*, when the cover unit 170 is installed at the one side of the developing device 30, the operating unit 150 is guided by the first guide rib 175 of the cover unit 170, and moved to the movable operating position 01*b*. Also, in the case in which the operating unit 150 is at the stand-by position 02, when the cover unit 170 is installed at the one side of the developing device 30, the operating unit 150 is guided by the second guide rib 176 of the cover unit 170, and moved to the movable operating position 01*b*. The operating unit guided by the first guide rib 175 or the second guide rib 176 is seated on the operating unit seating part 178, and maintained at the movable operating position 01*b*.

Of course, in the case in which the operating unit 150 is at the movable operating position 01*b*, when the cover unit 170 is installed at the one side of the developing device 30, the operating unit 150 is seated on the operating unit seating part 178, and maintained at the movable operating position 01*b*.

When the cover unit 170 is separated from the developing device 30 to replace the developing device 30, the operating unit 150 located at the movable operating position 01*b* is rotated to the stand-by position 02 by an elastic returning force of the pressing elastic member 134. As the operating unit 150 is rotated to the stand-by position 02, the pressing force of the pressing unit 120 applied to the developing unit 30*a* is released, and the developing roller 34 and the photoreceptor 32 are separated from each other.

Hereinafter, an image forming apparatus in accordance with an embodiment of the disclosure will be described.

Repeated description of the same structure as that previously described above will be omitted.

Figure 9:
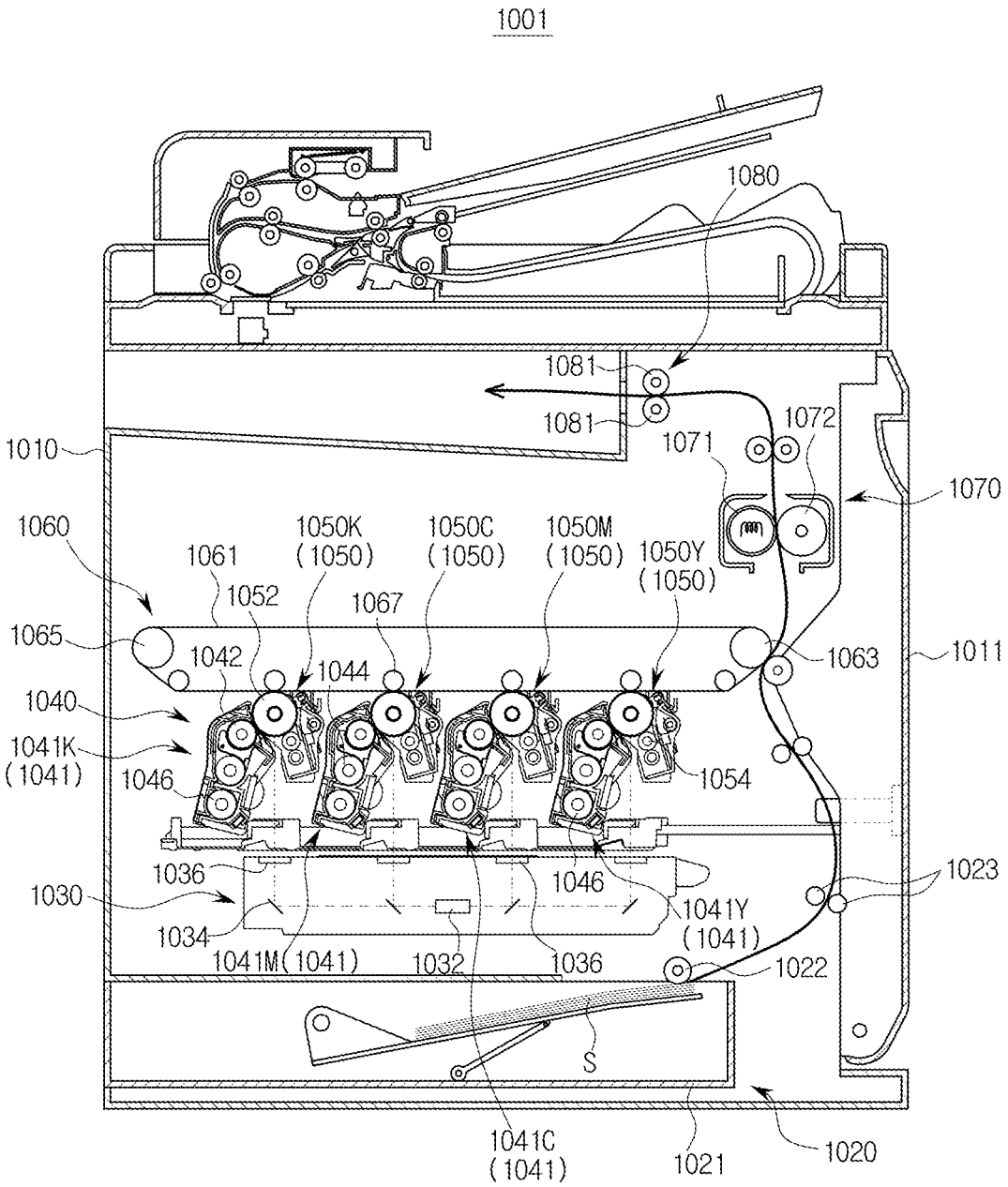
FIG. 9 is a cross-sectional view of an image forming apparatus in accordance with an embodiment of the disclosure.

FIG. 9 is a cross-sectional view of the image forming apparatus in accordance with an embodiment of the disclosure.

As illustrated in FIG. 9, the image forming apparatus 1001 may include a main body 1010, a print medium supplying unit 1020, an optical scanning unit 1030, a developing device 1040, a transfer unit 1060, a fixing unit 1070, and a print medium discharging unit 1080.

The main body 1010 defines an exterior of the image forming apparatus 1001, and also supports various components installed therein. Further, a cover 1011 may be rotatably installed at one side of the main body 1010. The cover 1011 serves to open and close a part of the main body 1010. A user may open the cover 1011, may have access to an inner side of the main body 1010, and may remove paper jammed in a printing path.

The print medium supplying unit 1020 may include a cassette 1021 in which a print medium S is stored, a pick-up roller 1022 which picks up each sheet of the print medium S stored in the cassette 1021, and a transporting roller 1023 which transports the picked-up print medium toward the transfer unit 1060.

The optical scanning unit 1030 may be disposed under a developing device 1040 to radiate light corresponding to image information onto a photoreceptor 1052 and thus to form an electrostatic latent image on a surface of the photoreceptor 1052. The optical scanning unit 1030 may include a light source 1032 which generates the light, a plurality of reflection mirrors 1034 which change a route of the light generated from the light source 1032, and a plurality of optical windows 1036 through which the light reflected by the plurality of reflection mirrors 1034 is transmitted.

The developing device 1040 may include a developing unit 1041 and a photoreceptor unit 1050.

Developing units 1041Y, 1041M, 1041C and 1041K which receive yellow (Y), magenta (M), cyan (C) and black (K) developers, respectively, have a developing roller 1042 and supplying rollers 1044 and 1046, respectively. The supplying rollers 1044 and 1046 serve to supply the developers to the developing roller 1042, and the developing roller 1042 serves to attach the developers on the surface of the photoreceptor on which the electrostatic latent image is formed and thus to form a visible image.

Each photoreceptor unit 1050Y, 1050M, 1050C, or 1050K corresponding to each developing unit 1041Y, 1041M, 1041C, or 1041K has a photoreceptor 1052 and a charger 1054. The charger 1054 serves to charge the photoreceptor 1052 with a predetermined electric potential, and the electrostatic latent image is formed on the surface of the charged photoreceptor 1052.

The transfer unit 1060 may include a transfer belt 1061 which is in contact with the photoreceptor 1052 of each photoreceptor unit 1050Y, 1050M, 1050C, or 1050K while being circulated, a driving roller 1063 which drives the transfer belt 1061, a tension roller 1065 which provides a predetermined tensile force to the transfer belt 1061, and four rollers 1067 which transfer the visible image developed on the photoreceptor 1052 of each photoreceptor unit 1050Y, 1050M, 1050C, or 1050K to the print medium P.

The fixing unit 1070 may include a heating roller 1071 which has a heating source, and a pressing roller 1072 which is installed so as to face the heating roller 1071. When the print medium passes between the heating roller 1071 and the pressing roller 1072, the image is fixed on the print medium by heat transmitted from the heating roller 1071 and pressure acting between the heating roller 1071 and the pressing roller 1072.

The print medium discharging unit 1080 has a plurality of discharging rollers 1081 so as to discharge the print medium passing through the fixing unit 1070 to an outside of the main body 1010.

Each photoreceptor unit 1050Y, 1050M, 1050C, or 1050K may be fixed to an inner side of the main body 1010, and each developing unit 1041Y, 1041M, 1041C, or 1041K may be provided to be attached or detached through one side of the main body 1010. When each developing unit 1041Y, 1041M, 1041C, or 1041K is installed at the main body 1010, each developing unit 1041Y, 1041M, 1041C, or 1041K is coupled to each photoreceptor unit 1050Y, 1050M, 1050C, or 1050K so as to be rotated about each rotating center CY, CM, CC, or CK. The developing rollers 1042 included in each developing unit 1041Y, 1041M, 1041C, or 1041K and the photoreceptors 1052 included in each photoreceptor unit 1050Y, 1050M, 1050C, or 1050K come into contact with each other, when the image forming apparatus 1001 performs the printing operation, and then are separated from each other, when each developing unit 1041Y, 1041M, 1041C, or 1041K is detached and replaced. Hereinafter, a structure in which the developing rollers 1042 and the photoreceptors 1052 are in contact with or separated from each other will be described in detail.

Figure 10:
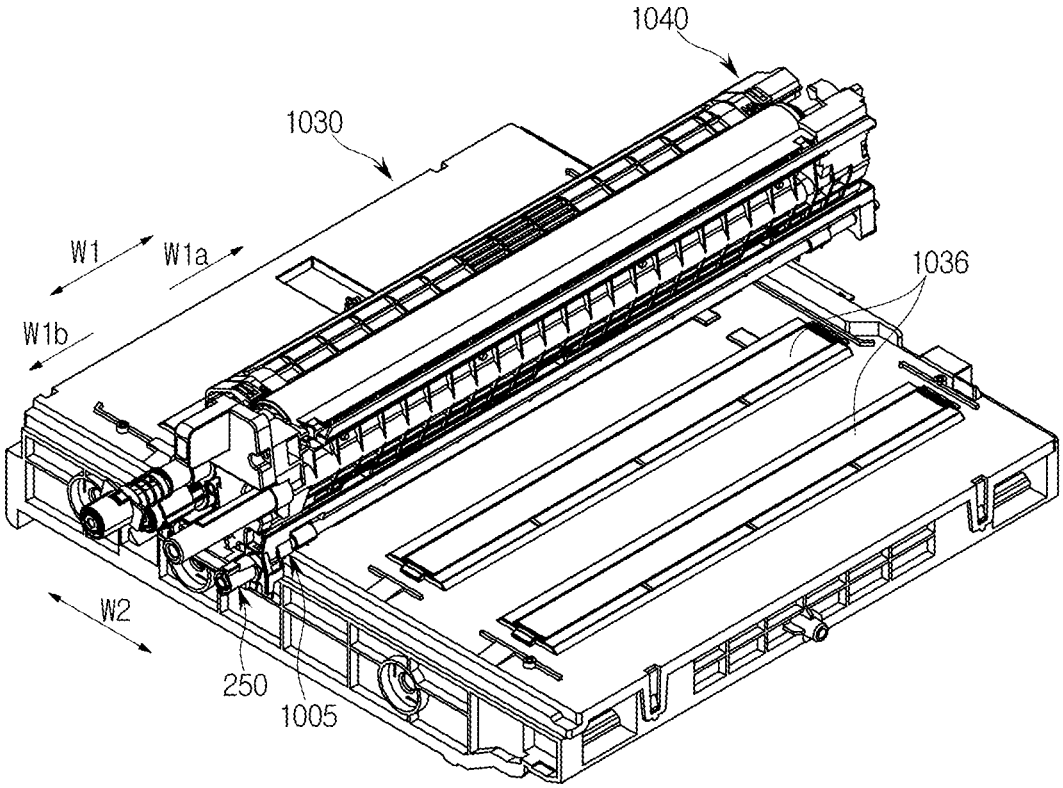
FIG. 10 is a view illustrating an arrangement of a developing device and an optical scanning unit of the image forming apparatus in accordance with an embodiment of the disclosure.

FIG. 10 is a view illustrating an arrangement of the developing device and the optical scanning unit of the image forming apparatus in accordance with a second embodiment of the disclosure.

The developing device 1040 may be provided to be seated on a developing device seating part 1005. A waste toner storing unit (not shown) which stores waste toner generated from the developing device 1040 may be provided at one side of the developing device 1040. Toner used in the developing device 1040 may be provided to be moved to the waste toner storing unit and then stored therein. In an embodiment of the disclosure, the waste toner storing unit may be referred to as a cover unit. The cover unit may be provided to guide an operation of an operating unit 250, as described previously. The description of this structure will be omitted below for the sake of brevity.

A pressing assembly 200 may be provided at one side of the developing device 1040 so that the developing unit 1041 and the photoreceptor unit 1050 come into close contact with each other. Specifically, the developing roller 1042 of the developing unit 1041 and the photoreceptor 1052 of the photoreceptor unit 1050 may come into close contact with or be separated from each other through an operation of the pressing assembly 200.

Figure 11A:
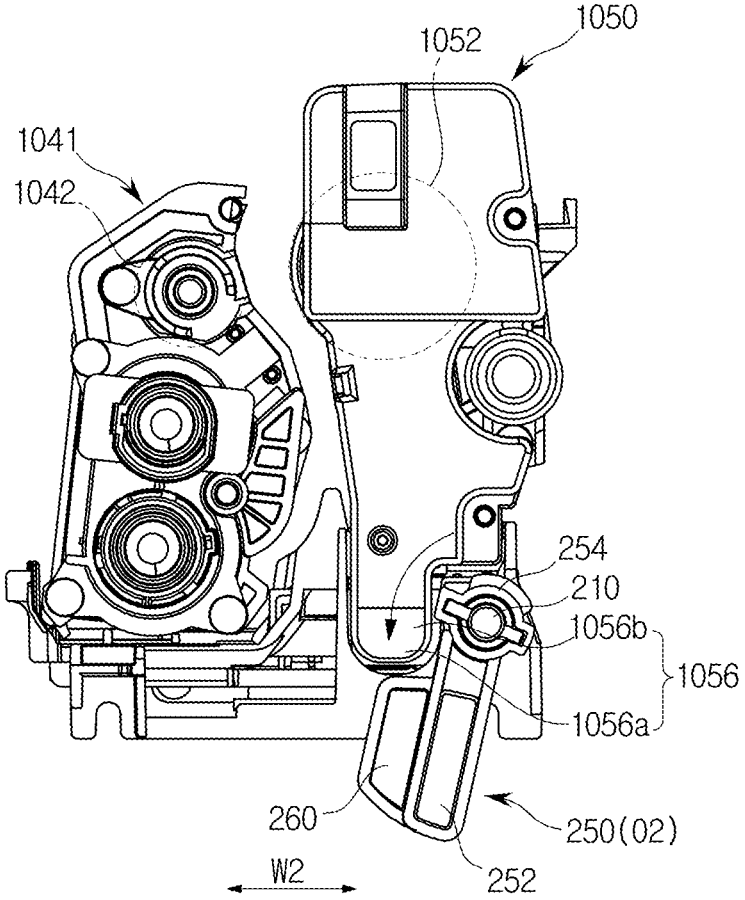
FIGS. 11A and 11B are views illustrating an operation of a pressing assembly and the developing device in accordance with an embodiment of the disclosure.
Figure 11B:
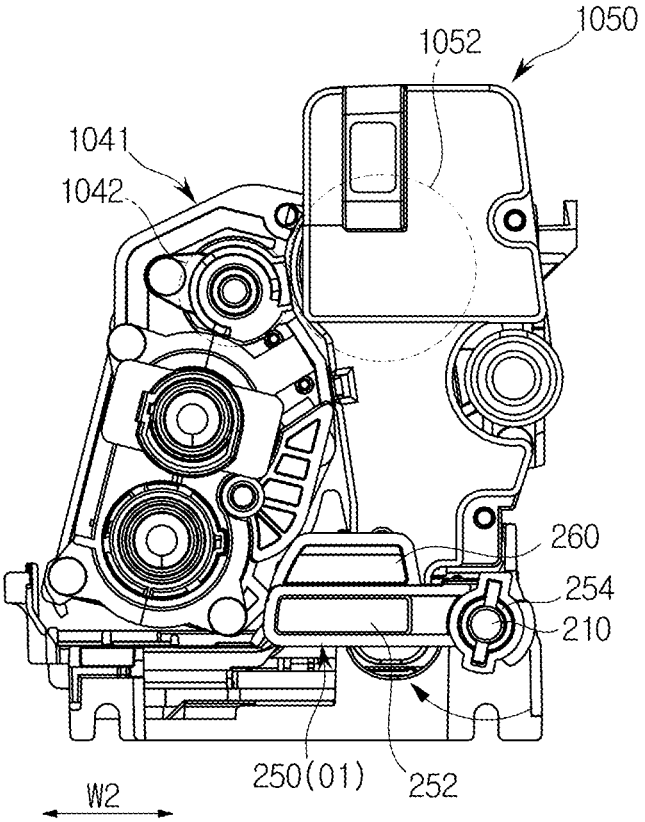
Figure 12A:
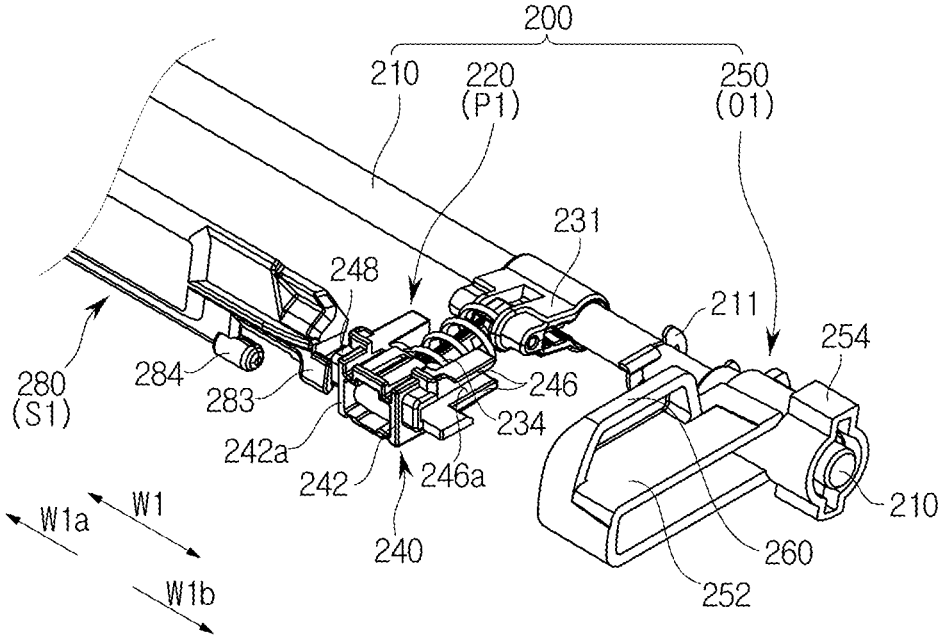
FIGS. 12A and 12B are perspective views illustrating the operation of the pressing assembly in accordance with an embodiment of the disclosure.
Figure 12B:
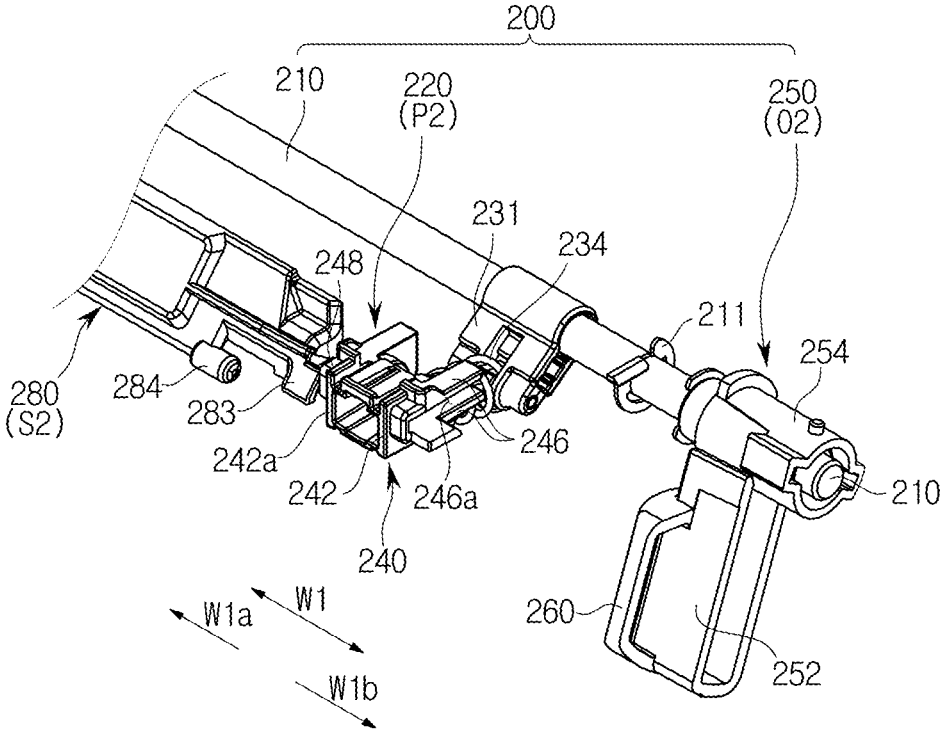
Figure 13A:
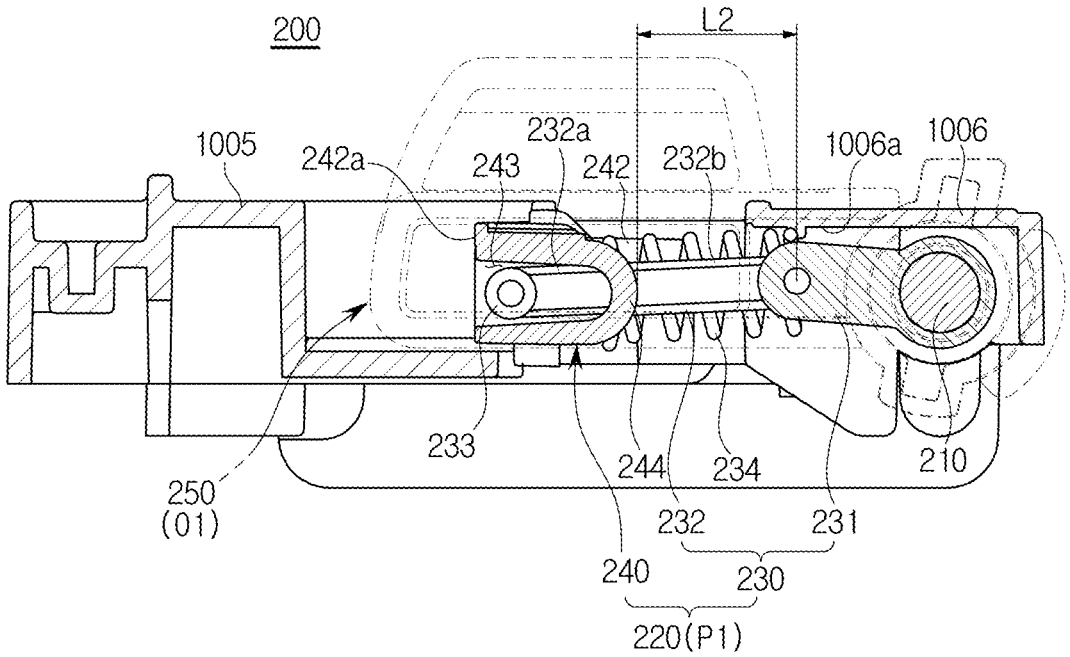
FIGS. 13A and 13B are cross-sectional views illustrating a pressing unit depending on the operation of the pressing assembly in accordance with an embodiment of the disclosure.
Figure 13B:
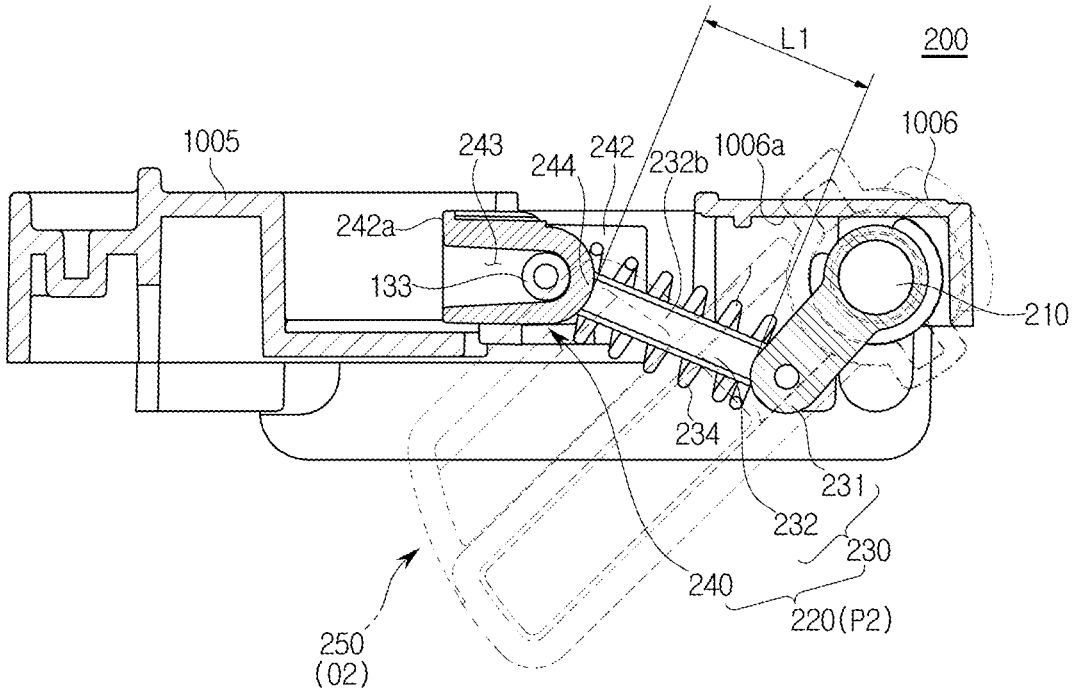
Figure 14A:
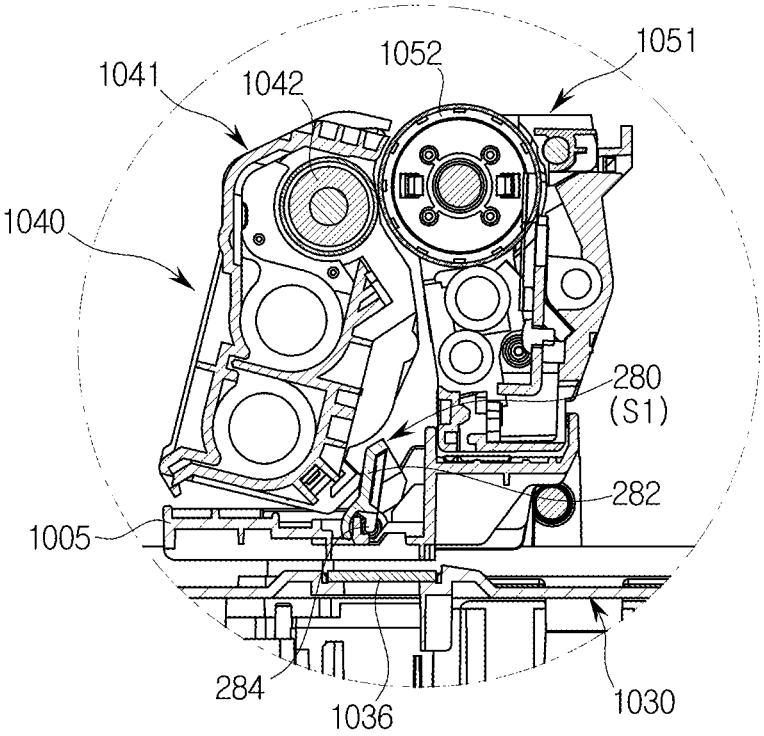
FIGS. 14A and 14B are cross-sectional views illustrating a shutter unit and the developing device depending on the operation of the pressing assembly in accordance with an embodiment of the disclosure.
Figure 14B:
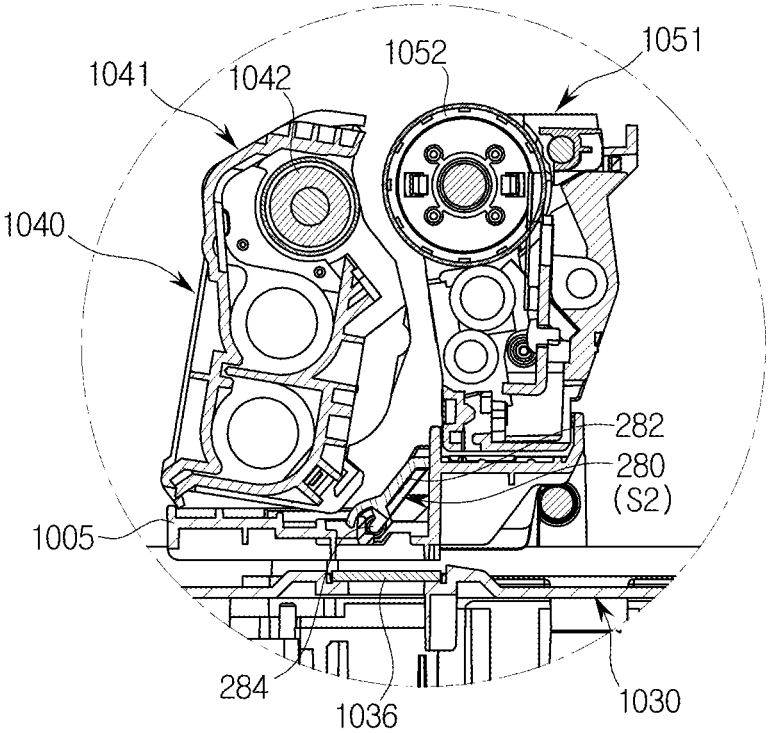

FIGS. 11A and 11B are views illustrating the operation of the pressing assembly and the developing device in accordance with an embodiment of the disclosure, FIGS. 12A and 12B are perspective views illustrating the operation of the pressing assembly in accordance with an embodiment of the disclosure, FIGS. 13A and 13B are cross-sectional views illustrating a pressing unit depending on the operation of the pressing assembly in accordance with an embodiment of the disclosure, and FIGS. 14A and 14B are cross-sectional views illustrating a shutter unit and the developing unit depending on the operation of the pressing assembly in accordance with an embodiment of the disclosure.

The pressing assembly 200 may be disposed adjacent to the developing device 1040 so that the developing unit 1041 and the photoreceptor unit 1050 come into contact with or are separated from each other. Specifically, the pressing assembly 200 may be provided so that the developing roller 1042 of the developing unit 1041 and the photoreceptor 1052 of the photoreceptor unit 1050 come into contact with or are separated from each other. An arrangement of the pressing assembly 200 is not limited. However, in an embodiment, the pressing assembly 200 may be disposed at the developing device seating part 1005.

The pressing assembly 200 may include a rotating shaft 210, a pressing unit 220, and an operating unit 250.

The rotating shaft 210 may be rotatably provided so that an operation of the operating unit 250 is transmitted to the pressing unit 220. At least one shaft stopper 211 may be provided at an outer circumferential surface of the rotating shaft 210 so that a movement of the rotating shaft 210 in a first direction W1 is restricted.

The pressing unit 220 may be provided so that the developing roller 1042 and the photoreceptor 1052 come into close contact with each other. The pressing unit 220 may be provided to be interlocked with the operating unit 250. The pressing unit 220 may be provided to be moved between a pressing position P1 in which the developing roller 1042 and the photoreceptor 1052 come into contact with each other, and a releasing position P2 which is moved backed from the pressing position P1 so that the developing roller 1042 and the photoreceptor 1052 are separated from each other.

The operating unit 250 may be provided to be rotatable, such that the pressing unit 220 is operated by the operation of the operating unit 250. That is, at least one pressing unit 220 may be provided to be interlocked with the operating unit 250.

The operating unit 250 may include an operating body 252 which is connected with the rotating shaft 210 so as to be rotated about the rotating shaft 210.

The operating unit 250 may be provided to be movable between an operating position 01 in which a pressing force is generated from the pressing unit 220 and a stand-by position 02 in which the pressing force is released.

The pressing unit 220 may include a link unit 230 and a pressing part 240.

The link unit 230 may include a first link member 231, a second link member 232, and a pressing elastic member 234. The second link member 232 may include a stopper insertion part 232*a* and a variable seating part 232*b*. A stopper pin 233 which is formed perpendicular to a lengthwise direction of the second link member 232 may be provided at an end of the second link member 232.

The pressing elastic member 234 may be provided to be maximally compressed, when the operating unit 250 is located between the operating position 01 and the stand-by position 02. That is, the pressing elastic member 234 may be compressed to a maximum compressed length ML, when the operating unit 250 is moved between the operating position 01 and the stand-by position 02.

An operation restricting surface 1006*a* may be provided above the link unit 230 so as to restrict an operation of the link unit 230. The operation restricting surface 1006*a* may be provided at an assembly cover 1006 of the developing device seating part 1005 to face an upper portion of the link unit 230.

The pressing part 240 may include a pressing body 242 and a pressing movement rail 246. A pressing surface 242*a* is provided at a front portion of the pressing body 242. The pressing surface 242*a* may be provided to come into direct contact with the developing unit 1041 and thus to press the developing unit 1041. A stopper moving part 243 through which the stopper pin 233 is moved is formed at the pressing body 242. The pressing part 240 may include a stopper rib 244 which is provided to limit a movement of the stopper pin 233 in the stopper moving part 243. The stopper rib 244 may be provided on the pressing body 242.

The pressing movement rail 246 is provided at the pressing body 242 so that the pressing part 240 reciprocates linearly. Specifically, a moving protrusion (not shown) is provided at the developing device seating part 1005 to correspond to the pressing movement rail 246, and the pressing movement rail 246 is provided to be moved along the moving protrusion.

One pair of pressing movement rails 246 may be provided up and down at both side surfaces of the pressing body 242, respectively, such that the moving protrusion is inserted therebetween. A protrusion insertion part 246*a* may be formed between one pair of pressing movement rails 246 so that the moving protrusion is inserted therein.

The pressing part 240 may include a shutter guide member 248.

The shutter guide member 248 may be provided to guide an operation of a shutter unit 280 and also to open and close an optical window 1036. In an embodiment, one pair of pressing units 220 may be provided to guide both sides of the shutter unit 280, such that the shutter unit 280 is operated. However, the disclosure is not limited thereto, and at least one pressing unit 220 may be provided so as to guide the operation of the shutter unit 280.

The shutter guide member 248 may be provided to protrude from one side surface of the pressing body 242 of the pressing part 240. That is, the shutter guide member 248 may be provided to have a protrusion shape which extends from the pressing body 242.

Specifically, the shutter guide member 248 may be formed to protrude from the pressing body 242, and may be formed to protrude perpendicular to a forward and backward moving direction of the pressing part 240. Due to such a structure, the shutter guide member 248 may guide the shutter unit 280 and a forward and backward movement of the pressing part 240.

The shutter unit 280 is provided to open and close the optical window 1036. Light generated from the optical scanning unit is radiated through the optical window 1036, and the radiated light passes through the optical window 1036 and is radiated onto the photoreceptor 1052. The shutter unit 280 is provided to open and close the optical window 1036, such that the light is selectively radiated onto the photoreceptor 1052.

The shutter unit 280 may include a shutter body 282 and a shutter rotating part 284 provided at the shutter body 282.

The shutter body 282 may be provided to correspond to the optical window 1036. The shutter body 282 may be formed in a lengthwise direction of the optical window 1036 or the photoreceptor 1052 so as to correspond to the optical window 1036 and the photoreceptor 1052. The shutter body 282 may be provided to be moved between an opening position S1 in which the optical window 1036 is opened and a closing position S2 in which the optical window 1036 is closed. The shutter body 282 may be rotated about the shutter rotating part 284 and thus may be moved between the opening position S1 and the closing position S2.

A shutter protrusion 283 which corresponds to the shutter guide member 248 of the pressing part 240 may be provided at the shutter body 282. The shutter protrusion 283 may be formed to protrude from the shutter body 282, and may be provided at an end of the shutter body 282. In an embodiment of the disclosure, since one pair of pressing units 220 is provided at both ends of the shutter unit 280, one pair of shutter protrusions 220 may be provided at both ends of the shutter body 282.

Due to such a structure, while the pressing unit 220 is moved from the releasing position P2 to the pressing position P1, the shutter guide member 248 of the pressing part 240 presses the shutter protrusion 283 of the shutter unit 280. Therefore, when the pressing unit 220 is at the pressing position P1, the developing unit 1041 is pressed, and at the same time, the shutter unit 280 is at the opening position S1.

A movement of the shutter unit 280 from the closing position S2 to the opening position S1 may be performed so that the shutter protrusion 283 is pressed by the shutter guide member 248, and a movement of the shutter unit 280 from the opening position S1 to the closing position S2 may be performed so that the shutter falls down due to its own weight. Of course, the movement of the shutter unit 280 from the opening position S1 to the closing position S2 may be interlocked with a movement of the pressing unit 220 from the pressing position P1 to the releasing position P2. However, in the embodiment, for example, the shutter unit 280 is provided to be operated by its own weight.

The shutter body 282 may be rotated about the shutter rotating part 284, and is provided so that an angle between the shutter body 282 when the shutter unit 280 is at the closing position S2 and the shutter body 282 when the shutter unit 280 is at the opening position S1 forms an acute angle. That is, a rotating angle of the shutter unit 280 between the opening position S1 and the closing position S2 forms the acute angle.

At the closing position S2, the shutter body 282 may be provided in parallel with the optical window 1036, and at the opening position S1, the shutter body 282 forms the acute angle with respect to the optical window 1036.

Due to such a structure, when the shutter unit 280 is moved from the opening position S1 to the closing position S2, the shutter body 282 may be moved by its own weight.

Figure 15:
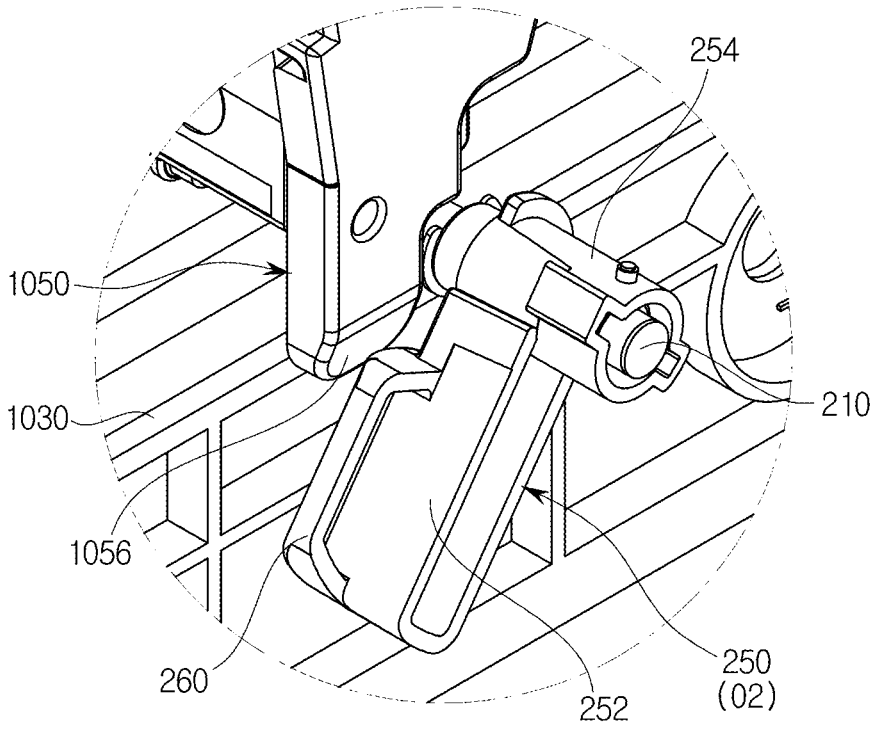
FIG. 15 is a perspective view illustrating an arrangement of an operating unit in accordance with an embodiment of the disclosure.
Figure 16:
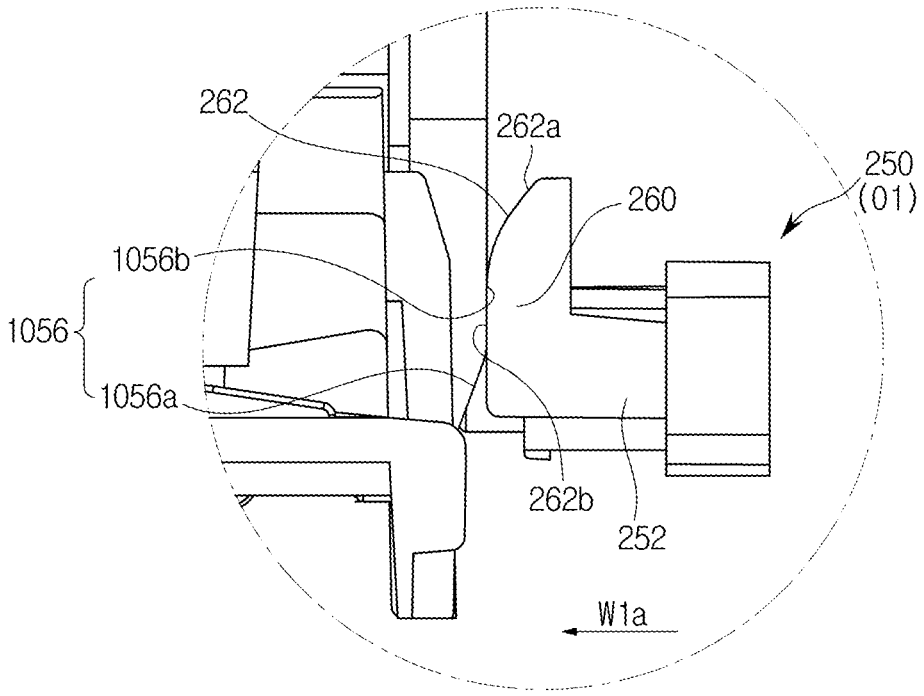
FIG. 16 is a side view illustrating a pressing state of the operating unit in accordance with an embodiment of the disclosure.
Figure 17:
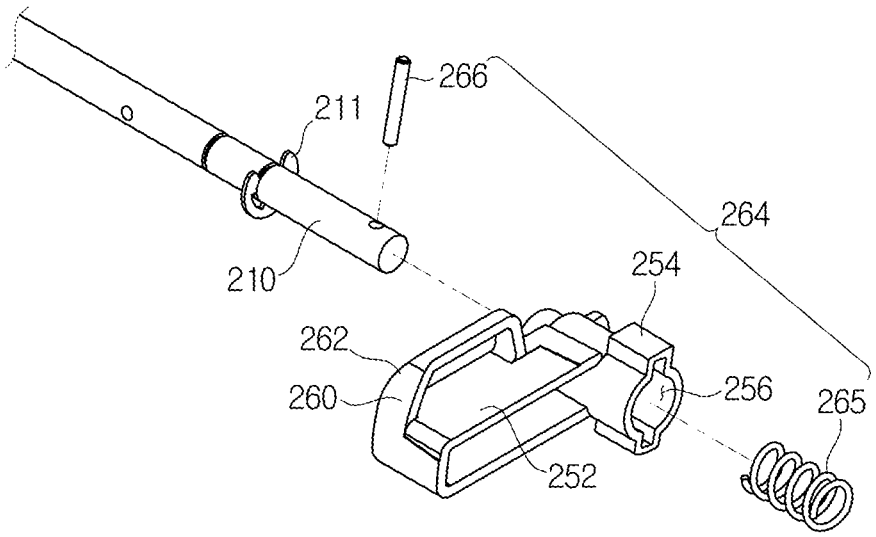
FIG. 17 is an exploded perspective view of the operating unit in the pressing assembly in accordance with an embodiment of the disclosure.
Figure 18:
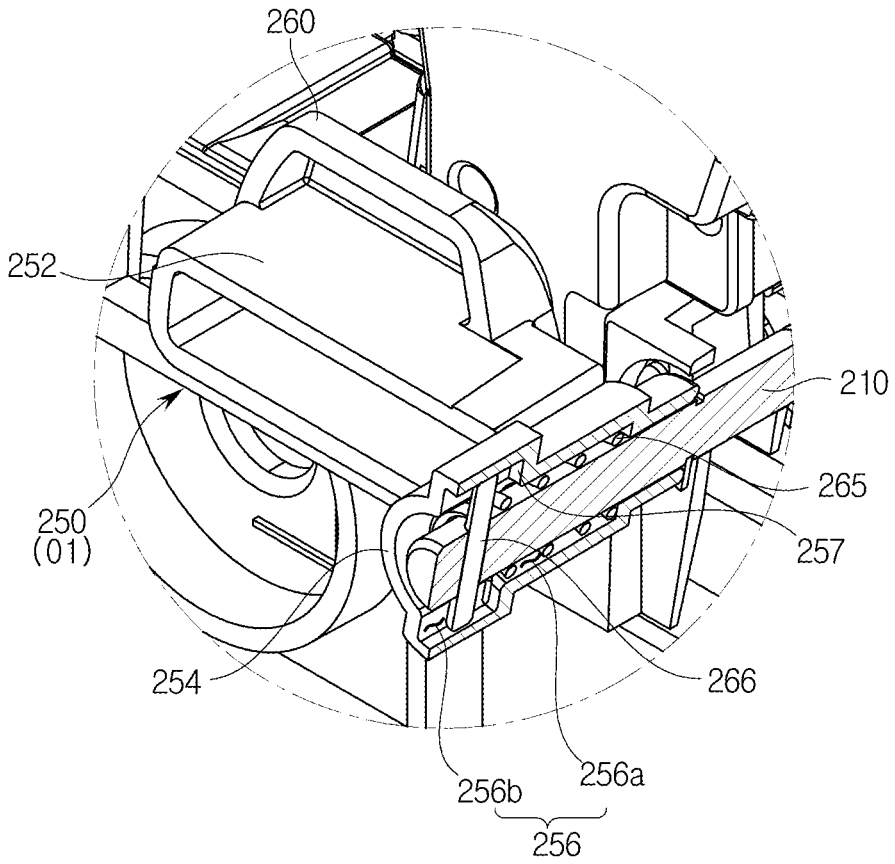
FIG. 18 is a cross-sectional perspective view illustrating the operating unit in accordance with an embodiment of the disclosure.

FIG. 15 is a perspective view illustrating an arrangement of the operating unit in accordance with an embodiment of the disclosure, FIG. 16 is a side view illustrating a pressing state of the operating unit in accordance with an embodiment of the disclosure, FIG. 17 is an exploded perspective view of the operating unit in the pressing assembly in accordance with an embodiment of the disclosure, and FIG. 18 is a cross-sectional perspective view illustrating the operating unit in accordance with an embodiment of the disclosure.

The operating unit 250 may be provided to be rotatable, such that the pressing unit 220 is operated by the operation of the operating unit 250. That is, the at least one pressing unit 220 is provided to be interlocked with the operating unit 250.

The operating unit 250 may include an operating body 252 which is connected with the rotating shaft 210 so as to be rotated about the rotating shaft 210.

The operating unit 250 is provided to be movable between an operating position 01 in which a pressing force is generated from the pressing unit 220 and a stand-by position 02 in which the pressing force is released.

When the operating unit 250 is located at the operating position 01, the pressing unit 220 presses the developing unit 1041, and when the operating unit 250 is located at the stand-by position 02, the pressing of the pressing unit 220 with respect to the developing unit 1041 is released.

The operating unit 250 may include the operating body 252 and a pressing member 260.

The operating body 252 may be provided to be rotated about the rotating shaft 210.

The pressing member 260 may be provided at the operating body 252 so as to press the developing device 1040 in a direction in which the developing device 1040 is installed at the developing device seating part 1005. The first direction W1 may include an installing direction W1*a* in which the developing device 1040 is installed at the developing device seating part 1005, and a separating direction W1*b* which is opposite to the installing direction W1*a* and in which the developing device 1040 is separated from the developing device seating part 1005. The pressing member 260 may be provided to press the developing device 1040 in the installing direction W1*a*. Specifically, the pressing member 260 may be provided to press the photoreceptor unit 1050 of the developing device 1040.

The operating unit 250 may include a rotating part 254. The rotating part 254 may be provided at the operating body 252 to be rotatably supported by the rotating shaft 210. The rotating part 254 has a hollow portion through which the rotating shaft 210 passes, and the operating body 252 extends from the rotating part 254 in a direction perpendicular to a rotating axis. One end of the rotating part 254 may be formed to be supported by the developing device seating part 1005.

An operation elastic part 264 may be provided at the rotating part 254, and the operating unit 250 may be provided to press the developing device 1040 in the installing direction W1*a*. The operation elastic part 264 will be described below in detail.

The pressing member 260 may include a pressing surface 262 which is formed toward the developing device 1040 so as to come into contact with the developing device 1040. The pressing surface 262 may be provided to come into direct contact with the developing device 1040. The pressing surface 262 may be provided to press the developing device 1040, while the operating unit 250 is moved from the stand-by position 02 to the operating position 01.

The pressing surface 262 may include a first pressing part 262*a* and a second pressing part 262*b*. The first pressing part 262*a* may be disposed in front of the second pressing part 262*b* in a direction in which the operating unit 250 is rotated from the stand-by position 02 to the operating position 01.

The first pressing part 262*a* may be provided to be more concave in the separating direction W1*b* than the second pressing part 262*b*.

Contrarily, the second pressing part 262*b* may be provided to be more convex in the installing direction W1*a* than the first pressing part 262*a*.

When the operating unit 250 is moved from the stand-by position 02 to the operating position 01, the developing device 1040 first comes into contact with the first pressing part 262*a*, and then into contact with the second pressing part 262*b*. That is, the second pressing part 262*b* which extends from the first pressing part 262*a* is formed to be more spaced apart in the installing direction W1*a* than the first pressing part 262*a*, and thus the second pressing part 262*b* comes into contact with the developing device 1040 after the operating unit 250 is moved to the operating position 01.

At least a part of the pressing surface 262 may be provided to form a curved surface. Thus, the second pressing part 262*b* may extend from the first pressing part 262*a* in the form of the curved surface. Due to such a structure, when the operating unit 250 is moved from the stand-by position 02 to the operating position 01, the developing device 1040 may be pressed smoothly.

A to-be-pressed surface 1056 is provided at the developing device 1040 to correspond to the pressing surface 262. The to-be-pressed surface 1056 is provided to be pressed by the pressing surface 262 of the operating unit 250. Specifically, the to-be-pressed surface 1056 may be provided at the photoreceptor unit 1050 of the developing device 1040.

The to-be-pressed surface 1056 may be inclined so as to correspond to the pressing surface 262. That is, the to-be-pressed surface 1056 may include a first to-be-pressed part 1056*a* with which the first pressing part 262*a* comes into contact, and a second to-be-pressed part 1056*b* with which the second pressing part 262*b* comes into contact and which is formed to extend from the first to-be-pressed part 1056*a* and to have a slope inclined in the separating direction W1*b*.

The operating unit 250 may include the operation elastic part 264.

The operation elastic part 264 may be provided at the rotating part 254 to provide the elastic force to the operating unit 250. That is, the operation elastic part 264 may be provided so as to provide the elastic force to the operating unit 250 in the installing direction W1*a*, such that the operating unit 250 presses the developing device 1040 in the installing direction W1*a*. The rotating part 254 may be formed in a cylindrical shape with a hollow internal space. An installing space 256 may be formed at an inner side of the rotating part 254 so that the operation elastic part 264 is located therein. The installing space 256 may include a first installing space 256*a* in which an installation elastic member 265 to be described below is installed, and a second installing space 256*b* in which a fastening member 266 is installed.

The operation elastic part 264 may include the installation elastic member 265 and the fastening member 266.

The fastening member 266 may be provided at the rotating shaft 210 to support one end of the installation elastic member 265. That is, since the movement of the rotating shaft 210 in the first direction W1 is restricted, and the fastening member 266 is disposed perpendicular to the axial direction, the installation elastic member 265 may be provided not to be separated from the fastening member 266. A shape of the fastening member 266 provided at the rotating shaft 210 is not limited specifically. In an embodiment of the disclosure, the fastening member 266 is formed in a pin shape, and provided to pass through the rotating shaft 210 perpendicular to the axial direction of the rotating shaft 210.

The operating unit 250 may include a movement restricting surface 257 which is provided to come into contact with the fastening member 266 and thus to restrict the movement of the operating unit 250 in the separating direction W1*b*. The second installing space 256*b* may be formed in the rotating part 254 using the movement restricting surface 257 as a boundary line. When the operating unit 250 is moved in the separating direction W1*b*, the fastening member 266 comes into contact with the movement restricting surface 257 of the operating unit 250, and thus the movement of the operating unit 250 in the separating direction W1*b* is restricted.

Since the fastening member 266 supports one end of the installation elastic member 265, a diameter of the second installing space 256*b* in which the fastening member 266 is installed is greater than that of the first installing space 256*a* in which the installation elastic member 265 is installed, and thus the movement restricting surface 257 may be formed from a circumference of the first installing space 256*a* to a circumference of the second installing space 256*b*.

The installation elastic member 265 may be disposed in the installing space 256. One end of the installation elastic member 265 may be supported by the fastening member 266, and the other end thereof is supported by an axial inner side surface of the rotating part 254. The installation elastic member 265 is provided to surround an outer circumferential surface of the rotating shaft 210, such that the elastic force generated from the installation elastic member 265 is axially transmitted to the operating unit 250. Specifically, the installation elastic member 265 generates the elastic force so as to press the operating unit 250 in the installing direction W1*a*.

Hereinafter, an operation of the image forming apparatus in accordance with an embodiment of the disclosure will be described.

After the developing device 1040 is seated on the developing device seating part 1005, the developing unit 1041 and the photoreceptor unit 1050 should come into close contact with each other so that the developing roller 1042 and the photoreceptor 1052 come into contact with each other, and thus the printing operation may be performed.

The pressing assembly 200 is operated so that the developing unit 1041 and the photoreceptor unit 1050 come into close contact with each other.

In the initial stage, the operating unit 250 may be located at the stand-by position 02, and when the developing device 1040 is seated on the developing device seating part 1005, the operating unit 250 is rotated so that pressing unit 220 presses the developing unit 1041.

When the operating unit 250 is rotated from the stand-by position 02 to the operating position 01, the link unit 230 of the pressing unit 220 is operated so that the pressing part 240 presses the developing unit 1041. The pressed developing unit 1041 comes into close contact with the photoreceptor unit 1050, and the developing roller 1042 and the photoreceptor 1052 come into contact with each other.

While the operating unit 250 is rotated from the stand-by position 02 to the operating position 01, the pressing unit 220 is moved from the releasing position P2 to the pressing position P1. While the pressing unit 220 is moved from the releasing position P2 to the pressing position P1, the pressing part 240 presses the developing unit 1041 and also opens the shutter unit 280 at the same time.

Specifically, the pressing surface 242*a* of the pressing part 240 presses the developing unit 1041, and the shutter guide member 248 of the pressing part 240 guides the rotation of the shutter unit 280. The shutter guide member 248 presses the shutter protrusion 283 of the shutter unit 280, and the shutter unit 280 is rotated about the shutter rotating part 284 and moved from the closing position S2 to the opening position S1.

When the operating unit 250 is rotated from the stand-by position 02 to the operating position 01, the developing device 1040 is in a state capable of forming an image, and at the same time, the light generated from the optical scanning unit is radiated onto the photoreceptor 1052.

When the operating unit 250 is at the operating position 01, the pressing unit 220 presses the developing unit 1041, and the operating unit 250 presses the photoreceptor unit 1050 of the developing device 1040 in the installing direction W1*a*. The pressing member 260 of the operating unit 250 presses the developing device 1040 in the installing direction W1*a*.

When the operating unit 250 is rotated from the stand-by position 02 to the operating position 01, the first pressing part 262*a* of the pressing member 260 first comes into contact with the first to-be-pressed part 1056*a* of the to-be-pressed surface 1056 of the developing device 1040. When the operating unit 250 is rotated to the operating position 01, the second pressing part 262*b* of the pressing member 260 comes into contact with the second to-be-pressed part 1056*b* of the to-be-pressed surface 1056 of the developing device 1040.

In this process, the operating unit 250 presses the photoreceptor unit 1050 of the developing device 1040 in the installing direction W1*a* by the elastic force generated by the operation elastic part 264.

When the operating unit 250 is rotated from the pressing position P1 to the stand-by position 02, a reverse process is performed.

Hereinafter, an image forming apparatus in accordance with an embodiment of the disclosure will be described.

Repeated description of the same structure as that described previously will be omitted.

Figure 19:
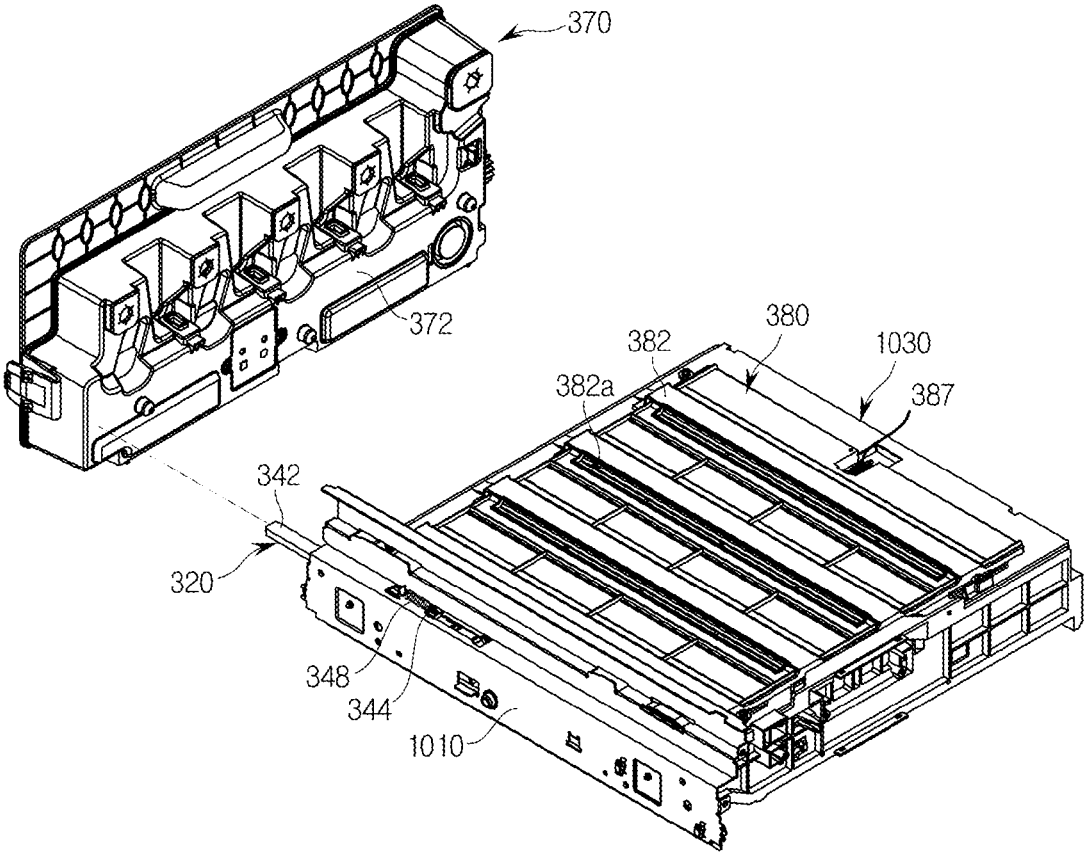
FIG. 19 is a view illustrating an arrangement of a developing device and a cover unit of an image forming apparatus in accordance with an embodiment of the disclosure.
Figure 20:
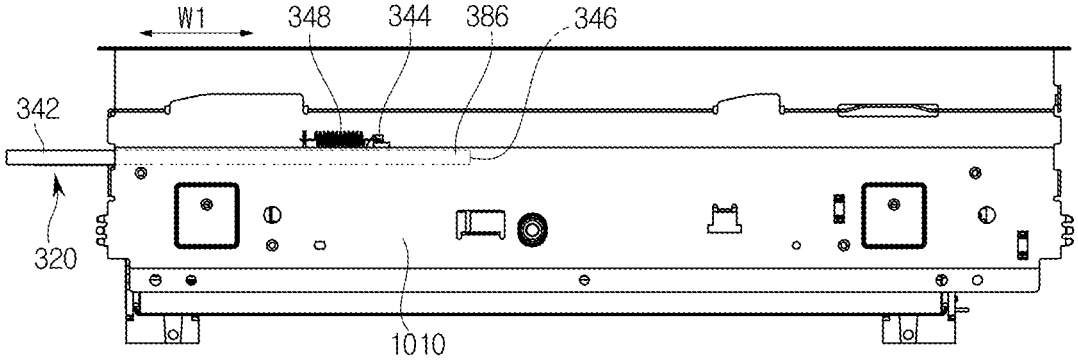
FIG. 20 is a front view illustrating a pressing unit in accordance with an embodiment of the disclosure.
Figure 21:
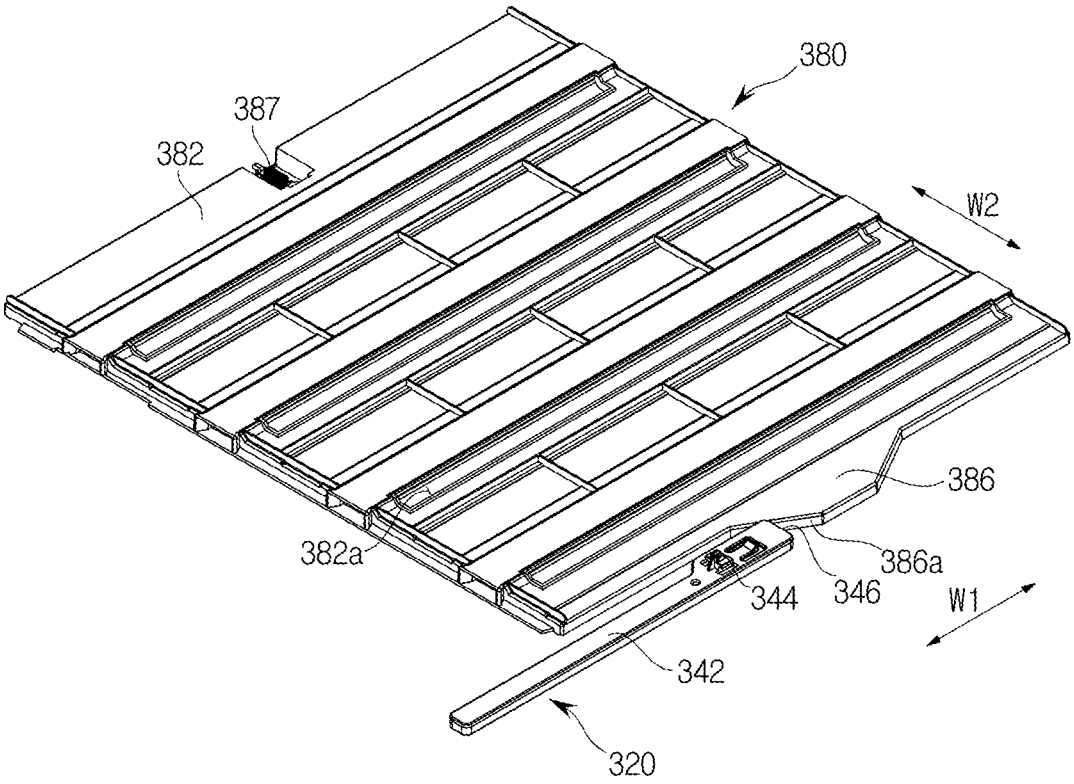
FIG. 21 is a perspective view illustrating the pressing unit and a shutter unit in accordance with an embodiment of the disclosure.

FIG. 19 is a view illustrating an arrangement of a developing device and a cover unit of the image forming apparatus in accordance with an embodiment of the disclosure, FIG. 20 is a front view illustrating a pressing unit in accordance with an embodiment of the disclosure, and FIG. 21 is a perspective view illustrating the pressing unit and a shutter unit in accordance with an embodiment of the disclosure.

The developing device 1040 may be provided to be seated on the developing device seating part 1005. The waste toner storing unit in which the waste toner generated from the developing device 1040 is stored may be provided at one side of the developing device 1040. The toner used in the developing device 1040 may be moved to the waste toner storing unit and stored therein. In an embodiment of the disclosure, the waste toner storing unit may be referred to as a cover unit 370.

A shutter unit 380 may be provided to open and close the optical window 1036. Light generated from the optical scanning unit is radiated through the optical window 1036, and the radiated light passes through the optical window 1036 and is radiated onto the photoreceptor 1052. The shutter unit 380 may be provided to open and close the optical window 1036, such that the light is selectively radiated onto the photoreceptor 1052.

The shutter unit 380 may include a shutter body 382, and a shutter to-be-pressed part 386 which is provided at the shutter body 382.

The shutter body 382 may be provided to correspond to the optical window 1036. The shutter body 382 may be elongated in a lengthwise direction of the optical window 1036 or a lengthwise direction of the photoreceptor 1052 so as to correspond to the optical window 1036 and the photoreceptor 1052. The shutter body 382 may be provided to be moved between the opening position S1 in which the optical window is opened, and the closing position S2 in which the optical window is closed. In an embodiment of the disclosure, since the image forming apparatus having a plurality of developing devices 1040 is applied, the shutter body 382 is also provided to correspond to the plurality of developing devices 1040. However, the image forming apparatus having a single developing device 1040, instead of the plurality of developing devices 1040, may also be applied.

The shutter body 382 may include a shutter hole 382*a* corresponding to the optical window 1036. The shutter hole 382*a* is elongated so as to correspond to the optical window 1036, and provided so that the light radiated to the optical window 1036 may pass through the photoreceptor 1052.

When the shutter unit 380 is at the opening position S1, the light radiated to the optical window 1036 may pass through the shutter hole 382*a*, and when the shutter unit 380 is at the closing position S2, the light radiated to the optical window 1036 may be blocked by the shutter body 382.

The light which is selectively radiated to the optical window 1036 through the movement of the shutter unit 380 between the opening position S1 and the closing position S2 may be transmitted to the photoreceptor 1052.

Assuming that the lengthwise direction of the optical window 1036 or the lengthwise direction of the photoreceptor unit 1050 is a first direction W1, the shutter unit 380 is provided to reciprocate in a second direction W2 vertical to the first direction W1.

The shutter unit 380 may include a returning elastic member 387. The returning elastic member 387 may be provided at one side of the shutter body 382 so that the shutter unit 380 is returned from the opening position S1 to the closing position S2. One end of the returning elastic member 387 is supported by the shutter body 382, and the other end thereof is supported by the developing device seating part 1005. Due to such a structure, when the pressing of the pressing unit 320 is released, the shutter unit 380 may be elastically returned from the opening position S1 to the closing position S2. An arrangement of the returning elastic member 387 is not limited. However, in the embodiment of the disclosure, the returning elastic member 387 is disposed on a moving route of the shutter unit 380. Specifically, the returning elastic member 387 is disposed at a rear side of a moving route of the shutter body 382 so that the shutter body 382 is elastically returned.

The pressing unit 320 is provided to be interlocked with the shutter unit 380. The pressing unit 320 is provided to be moved between a pressing position P1 in which the shutter unit 380 is pressed, and a releasing position P2 in which the pressing applied to the shutter unit 380 is released.

The pressing unit 320 may include a pressing body 342 and a pressing elastic member 348 which provides an elastic force to the pressing body 342.

The pressing body 342 may be provided to reciprocate by an external force. The pressing body 342 may be formed to be elongated in the first direction W1. One end of the pressing body 342 receives the external force in the first direction W1, and the other end thereof transmits the external force to the shutter unit 380.

The pressing body 342 may be formed to be elongated in the first direction W1 and to reciprocate in the first direction W1. Specifically, the pressing body 342 may be moved in an installing direction W1*a* of the first direction W1 by the external force, and returned in a separating direction W1*b* when the external force is released. That is, the pressing body 342 is moved from the releasing position P2 to the pressing position P1 by the external force, and returned from the pressing position P1 to the releasing position P2 when the external force is released.

The pressing elastic member 348 may be provided so that the pressing unit 320 moved in the installing direction W1*a* is returned in the separating direction W1*b*. The pressing body 342 may include an elastic catching protrusion 344 which protrudes from the pressing body 342 so that one end of the pressing elastic member 348 is supported thereby. One end of the pressing elastic member 348 may be supported by the elastic catching protrusion 344 which protrudes from the pressing body 342, and the other end thereof may be supported by the main body. When the external force is applied to the pressing body 342, and thus the pressing body 342 is moved in the installing direction W1*a*, the pressing elastic member 348 generates the elastic force by which the pressing body 342 is moved in the separating direction W1*b*, and when the external force is released, the pressing body 342 is returned to its original position by the elastic force.

The other end of the pressing body 342 is provided so as to press the shutter unit 380. Specifically, the pressing body 342 may include a pressing part 346 which presses the shutter unit 380. The pressing part 346 presses the shutter to-be-pressed part 386 of the shutter unit 380. Since the pressing unit 320 reciprocates in the first direction W1, and the shutter unit 380 reciprocates in the second direction W2 perpendicular to the first direction W1, the shutter to-be-pressed part 386 of the shutter unit 380 has an inclined surface which is inclined in the first and second directions W1 and W2.

That is, the shutter to-be-pressed part 386 may include a pressing inclined surface 386*a* having a component of the first direction W1 and a component of the second direction W2 so that the shutter unit 380 is operated in the second direction W2 perpendicular to the first direction W1. The pressing part 346 of the pressing body 342 comes into contact with the pressing inclined surface 386*a* and then presses the pressing inclined surface 386*a*, and thus the shutter unit 380 may be moved in the second direction W2.

The cover unit 370 may be detachably provided at one side of the developing device 1040. The cover unit 370 may be provided so that the operation of the pressing unit 320 is interlocked with an attachment and detachment of the cover unit 370. Specifically, the cover unit 370 moves the pressing unit from the releasing position P2 to the pressing position P1, while installed at one side of the developing device 1040. Contrarily, when the cover unit 370 is separated from the one side of the developing device 1040, the pressing unit 320 is moved from the pressing position P1 to the releasing position P2.

Hereinafter, an operation of the image forming apparatus in accordance with an embodiment of the disclosure will be described.

Figure 22A:
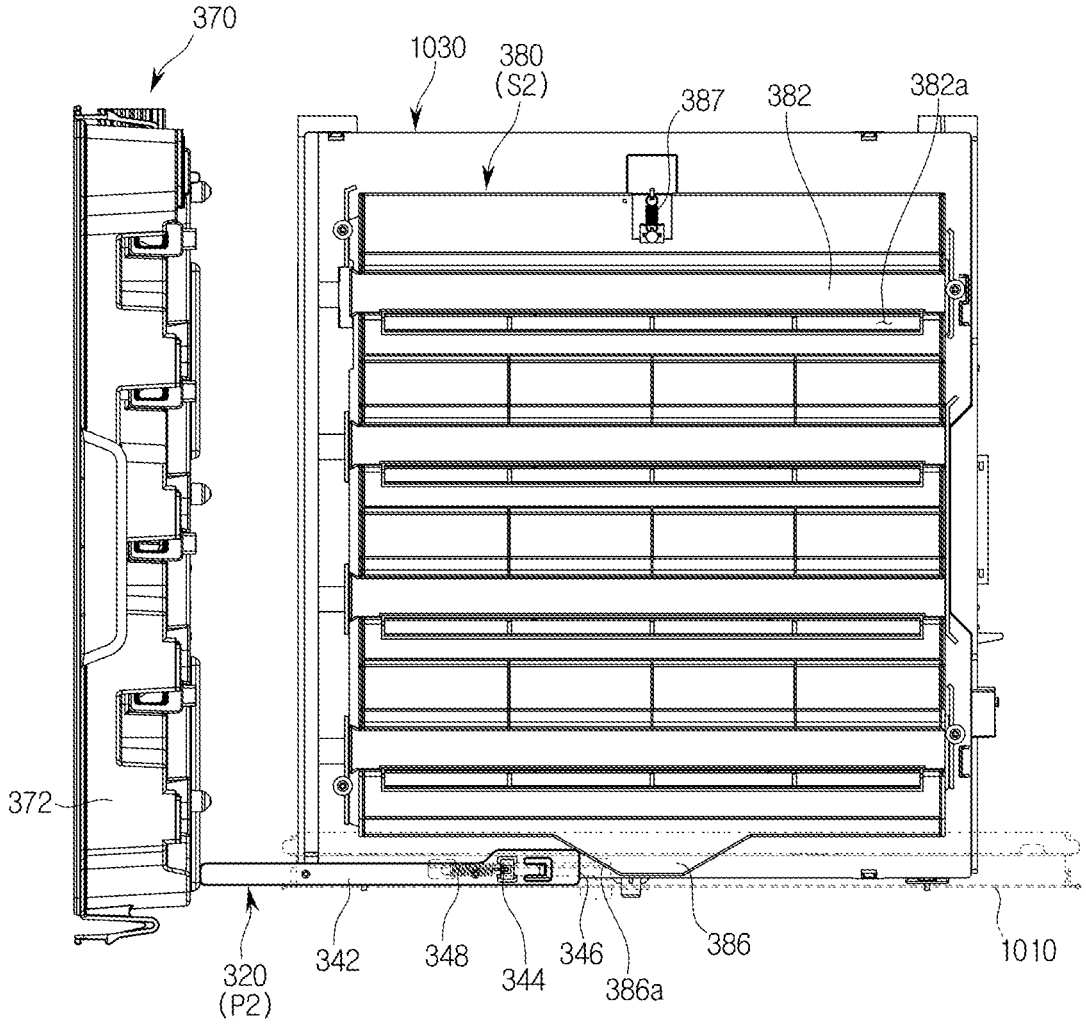
FIGS. 22A and 22B are views illustrating an interlocking operation of the pressing unit, the shutter unit and the cover unit in accordance with an embodiment of the disclosure.
Figure 22B:
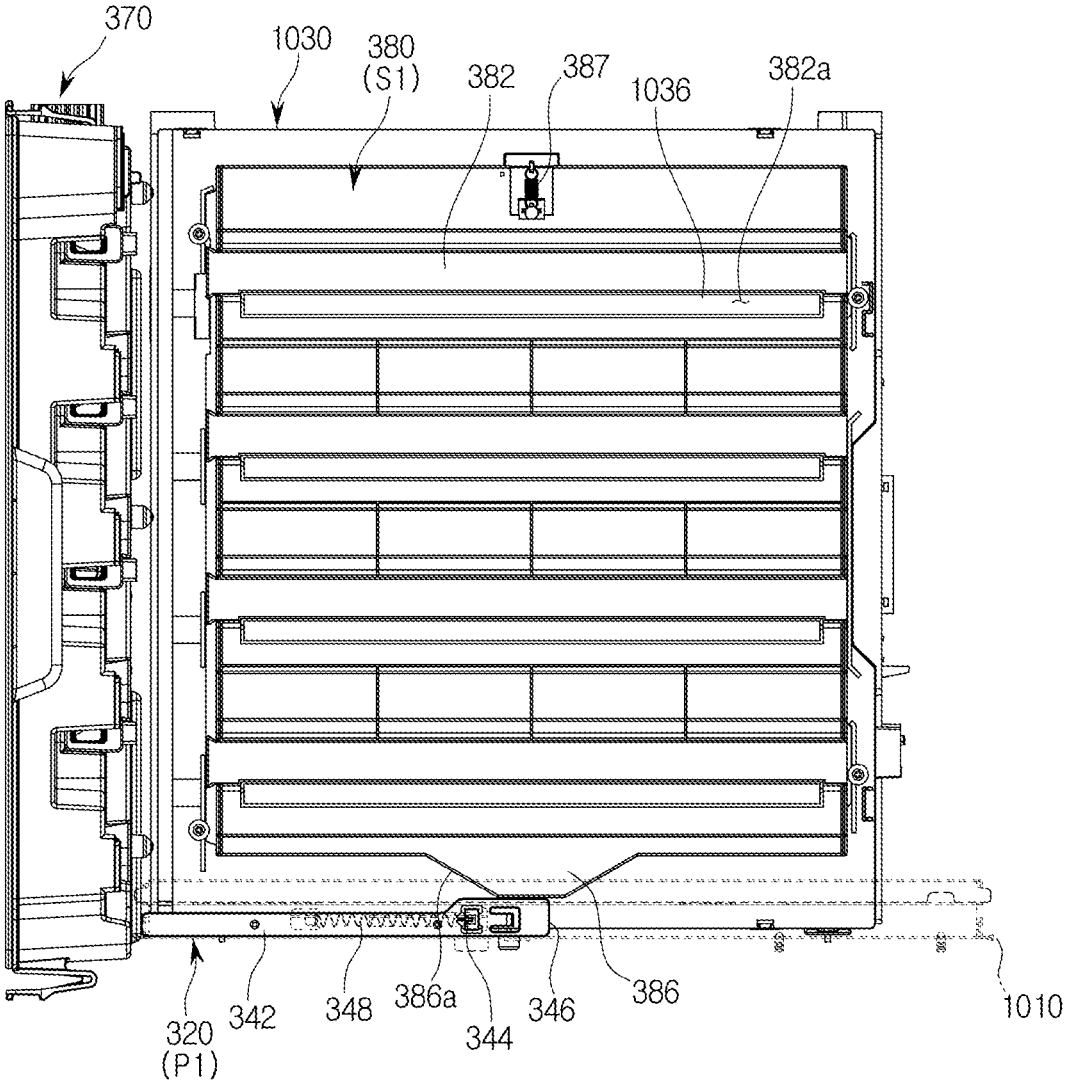

FIGS. 22A and 22B are views illustrating an interlocking operation of the pressing unit, the shutter unit and the cover unit in accordance with an embodiment of the disclosure.

First, an operation in which the shutter unit 380 is opened will be described.

When the pressing unit 320 is moved from the releasing position P2 to the pressing position P1, the pressing part 346 of the pressing unit 320 presses the shutter unit 380, and moves the shutter unit 380 from the closing position S2 to the opening position S1.

Specifically, while the pressing unit 320 is moved from the releasing position P2 to the pressing position P1, the pressing part 346 is moved in the first direction W1 so as to press the shutter to-be-pressed part 386 of the shutter unit 380. The pressing inclined surface 386*a* of the shutter to-be-pressed part 386 converts the movement of the pressing part 346 in the first direction W1 into the movement of the shutter unit 380 in the second direction W2.

While the shutter unit 380 is moved from the closing position S2 to the opening position S1, the light radiated to the optical window 1036 is transmitted to the photoreceptor 1052, and thus the electrostatic latent image may be formed.

The pressing unit 320 may be directly moved from the releasing position P2 to the pressing position P1, or the pressing unit 320 may be operated by the cover unit 370, similar to the embodiment of the disclosure.

When the cover unit 370 is installed at one side of the developing device 1040, the cover body of the cover unit 370 presses the pressing unit 320 so that the pressing unit 320 is moved from the releasing position P2 to the pressing position P1. Through such a structure, the cover unit 370 is installed at the developing device 1040 so that the developing device 1040 is in an available state, and also the optical window 1036 is opened so that the light may be radiated.

Then, an operation in which the shutter unit 380 is closed will be described.

When the pressing unit 320 is moved from the pressing position P1 to the releasing position P2, the pressing of the pressing part 346 of the pressing unit 320 with respect to the shutter unit 380 is released. When the pressing of the pressing unit 320 is released, the returning elastic member 387 of the shutter unit 380 returns the shutter unit 380 from the opening position S1 to the closing position S2.

In the case in which the pressing unit 320 is directly moved from the releasing position P2 to the pressing position P1, when the pressing with respect to the pressing unit 320 is released, the pressing unit 320 is moved from the pressing position P1 to the releasing position P2 by the elastic force of the pressing elastic member 348.

Similar to an embodiment of the disclosure, in the case in which the pressing unit 320 is pressed by the cover unit 370, when the cover unit 370 is separated from the developing device 1040, the restriction on the pressing unit 320 by the cover unit 370 is released, and the pressing unit 320 is moved from the pressing position P1 to the releasing position P2 by the elastic force of the pressing elastic member 348.

Hereinafter, an image forming apparatus in accordance with an embodiment of the disclosure will be described.

Figure 23:
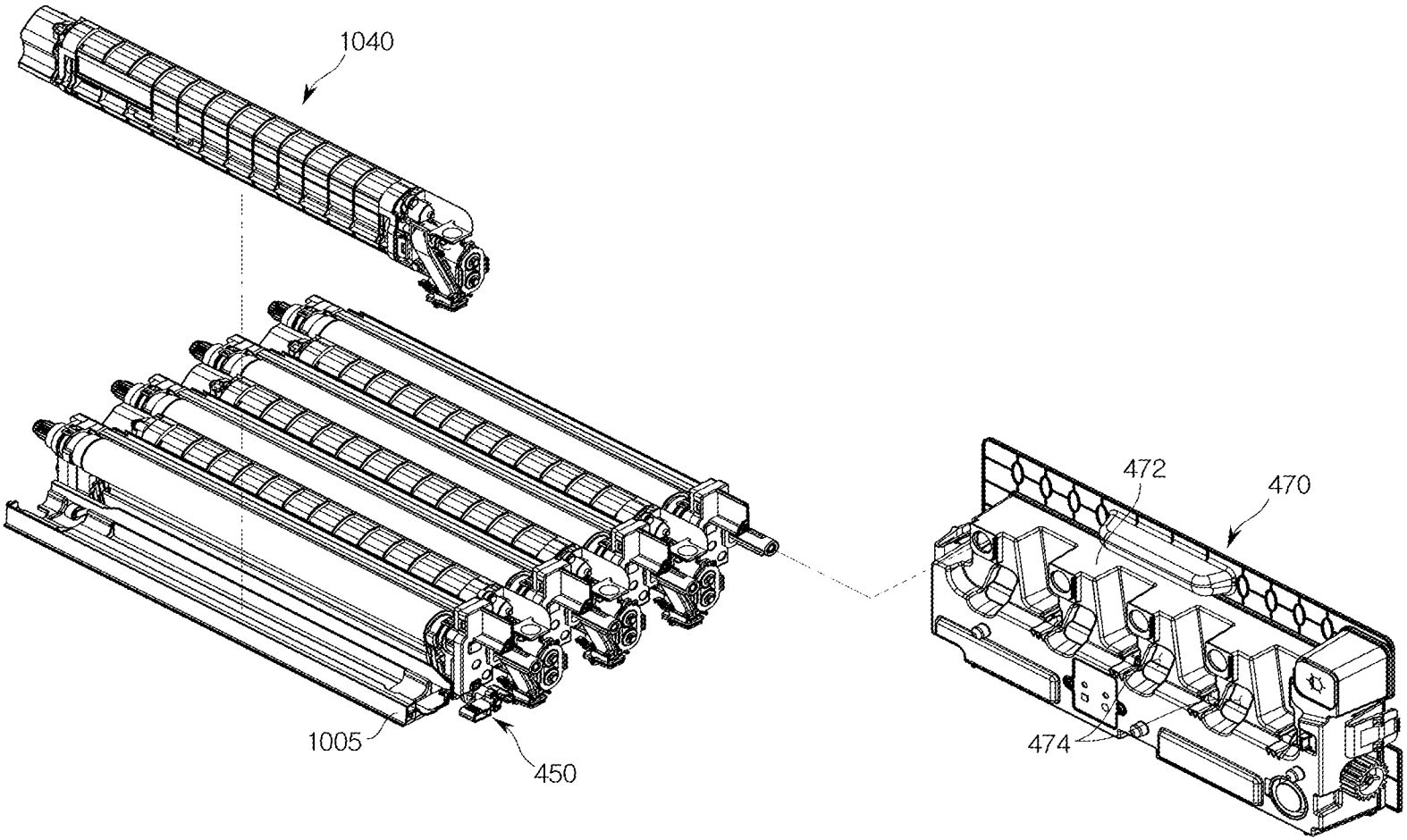
FIG. 23 is a view illustrating a developing device and a cover unit in accordance with an embodiment of the disclosure.
Figure 24A:
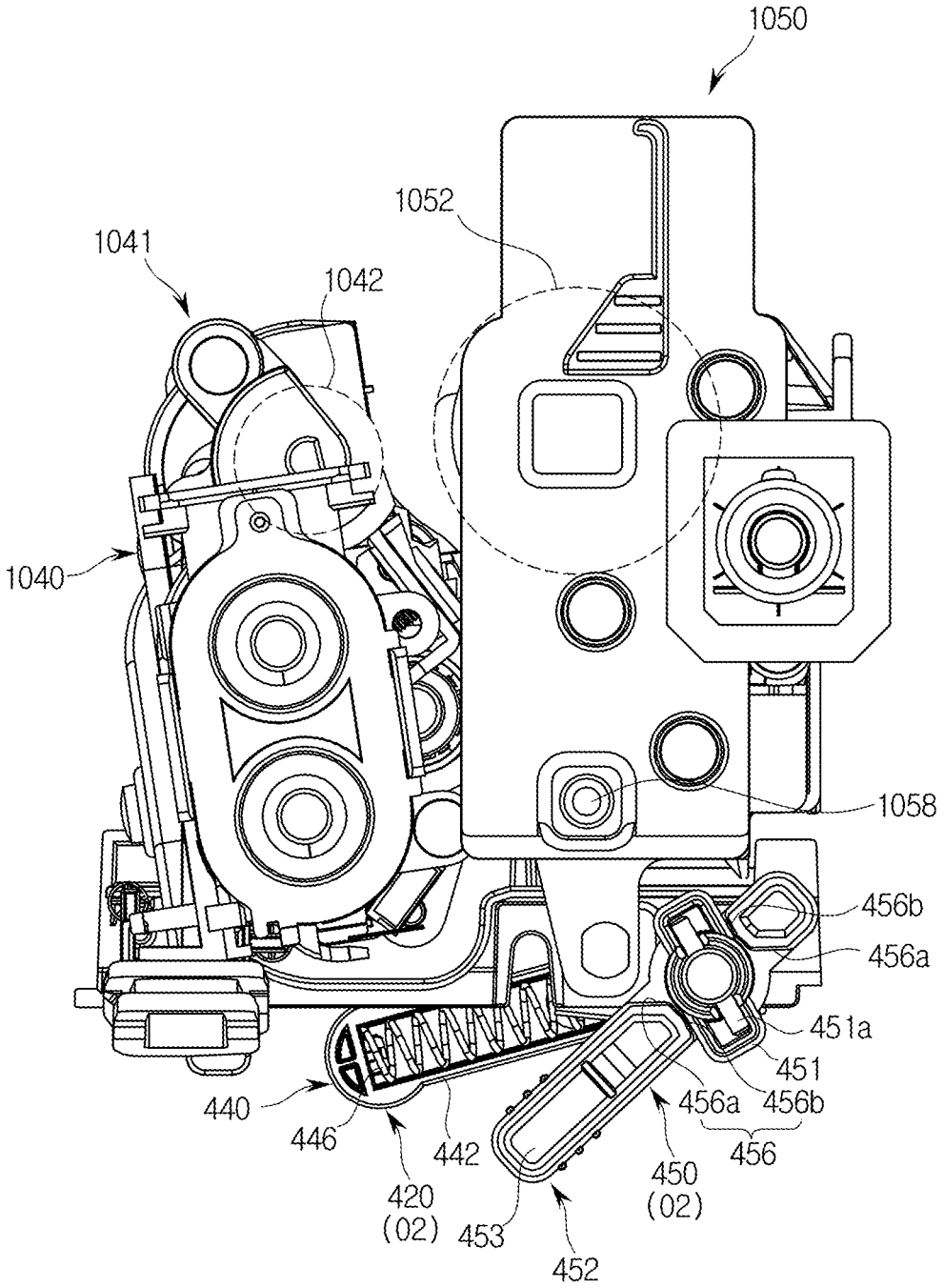
FIGS. 24A and 24B are views illustrating an operation of a pressing assembly and the developing device in accordance with an embodiment of the disclosure.
Figure 24B:
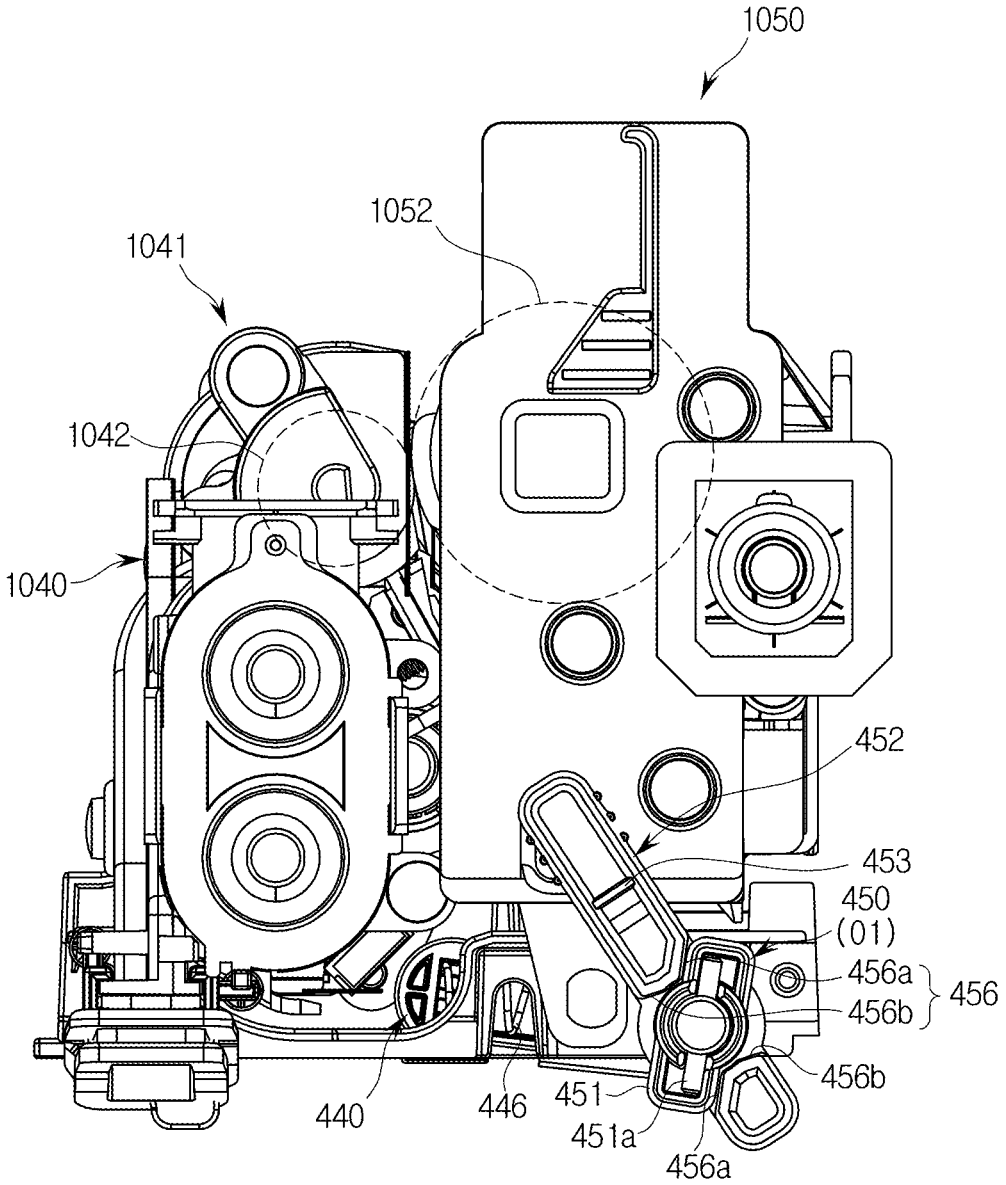
Figure 25A:
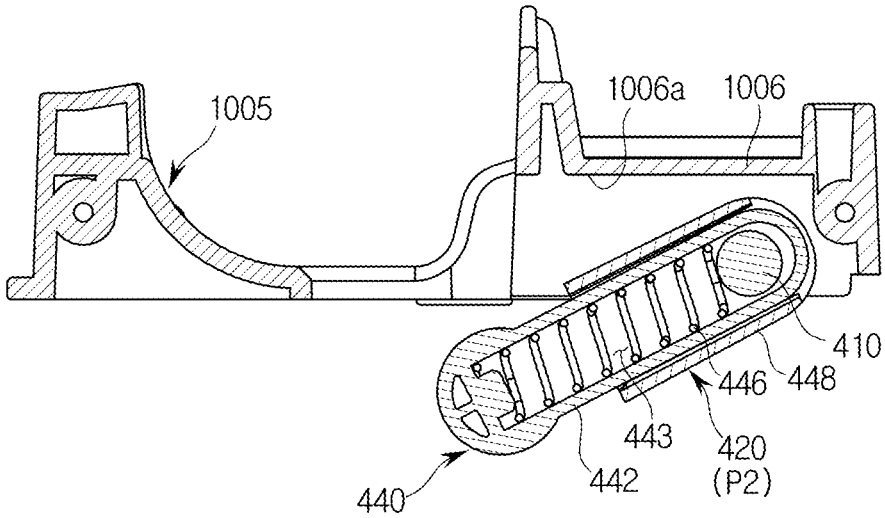
FIGS. 25A and 25B are cross-sectional views illustrating a pressing unit depending on the operation of the pressing assembly in accordance with an embodiment of the disclosure.
Figure 25B:
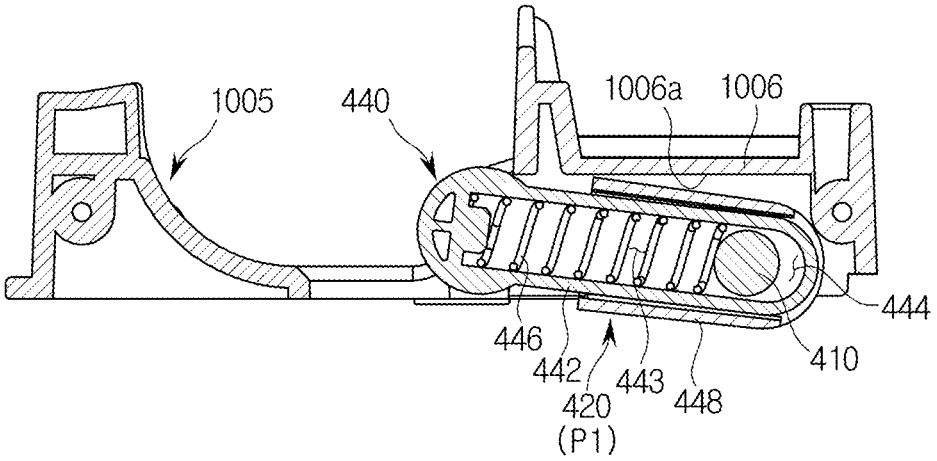
Figure 26:
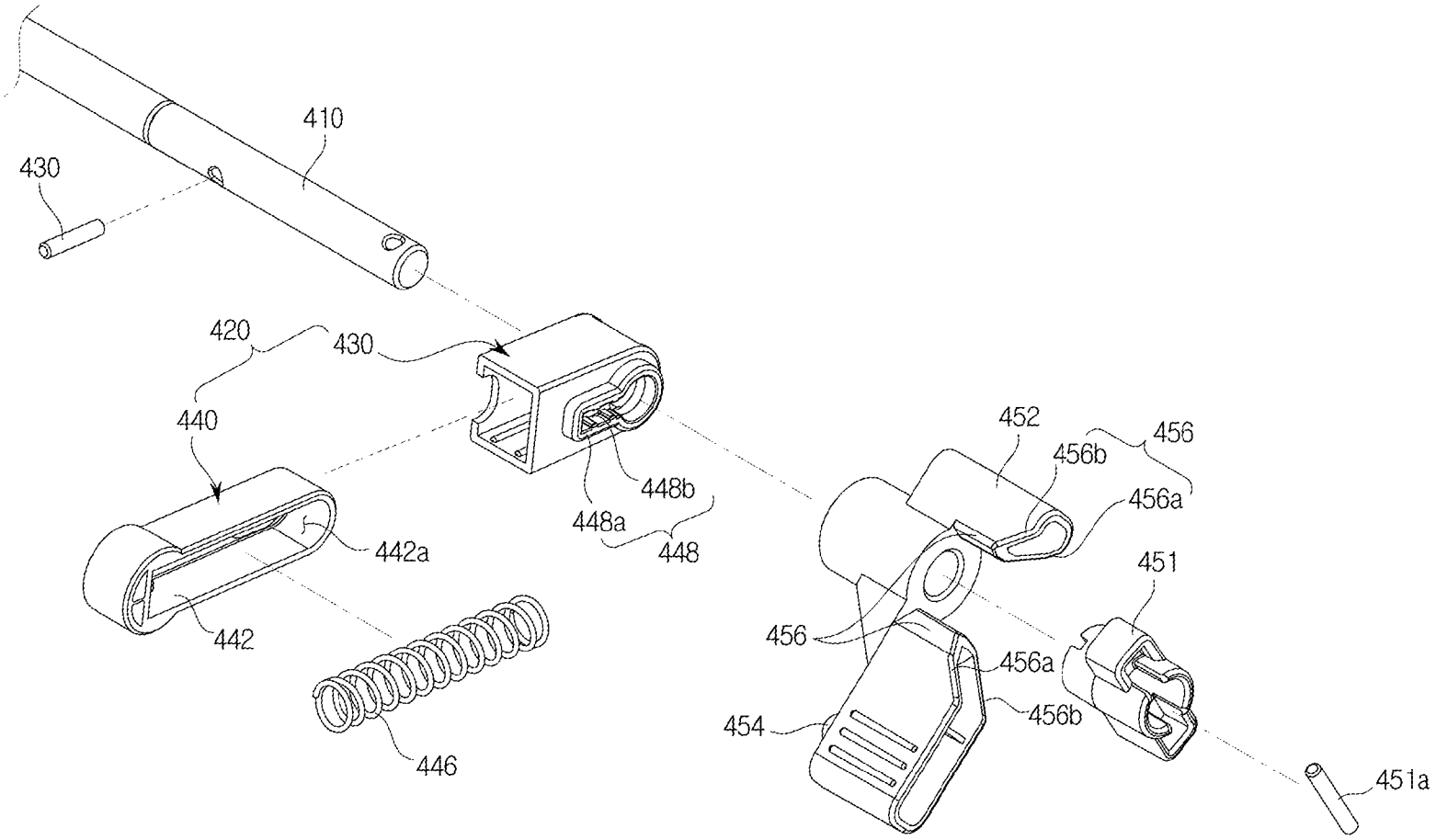
FIG. 26 is an exploded perspective view of the pressing assembly in accordance with an embodiment of the disclosure.

FIG. 23 is a view illustrating a developing device and a cover unit in accordance with an embodiment of the disclosure, FIGS. 24A and 24B are views illustrating an operation of a pressing assembly and the developing device in accordance with an embodiment of the disclosure, FIGS. 25A and 25B are cross-sectional views illustrating a pressing unit depending on the operation of the pressing assembly in accordance with an embodiment of the disclosure, and FIG. 26 is an exploded perspective view of the pressing assembly in accordance with an embodiment of the disclosure.

A pressing assembly 100 may be disposed adjacent to the developing device 1040, such that the developing unit 1041 and the photoreceptor unit 1050 come into contact with or are separated from each other. Specifically, the pressing assembly 100 is provided so that the developing roller 1042 of the developing unit 1041 and the photoreceptor 1052 of the photoreceptor unit 1050 come into contact with or are separated from each other. An arrangement of the pressing assembly 100 is not limited. However, in an embodiment, the pressing assembly 100 is disposed at the developing device seating part 1005.

The pressing assembly 400 may include a rotating shaft 410, a pressing unit 420, and an operating unit 450.

The rotating shaft 410 may be rotatably provided so that an operation of the operating unit 450 is transmitted to the pressing unit 420. Assuming that a lengthwise direction of the developing device 1040, the developing unit 1041 and the photoreceptor unit 1050 is a first direction W1, the rotating shaft 410 may be formed to be elongated in the first direction W1. The first direction W1 may be defined as a direction vertical to a moving direction of the print medium. The rotating shaft 410 may serve as a rotating center of the operating unit 450, which will be described below.

The rotating shaft 410 may be disposed in the first direction W1 and may be provided so that a movement thereof in the first direction W1 is restricted. The rotating shaft 410 may be provided to be rotated about a rotating axis. At least one shaft stopper may be provided at an outer circumferential surface of the rotating shaft 410 (in a manner similar to shaft stopper 211) so that a movement of the rotating shaft 410 in the first direction W1 is restricted.

The pressing unit 420 is provided so that the developing roller 1042 and the photoreceptor 1052 come into close contact with each other. Specifically, the pressing unit 420 is provided to press the developing unit 1041, such that the developing roller 1042 and the photoreceptor 1052 come into contact with or in close contact with each other. The pressing unit 420 may be disposed on the rotating shaft 410, and may be provided so as to receive an operation of the operating unit 450 through the rotating shaft 410 and thus to be operated thereby.

The pressing unit 420 may be provided to be interlocked with the operating unit 450. At least one pressing unit 420 may be provided. Through such a structure, at least one pressing unit 420 is provided to be interlocked with operating unit 450 and thus to be operated. In the case in which a plurality of pressing units 420 are provided, the plurality of pressing units 420 may be disposed on the rotating shaft 410 to be spaced from each other. As an example, the plurality of pressing units 420 may be disposed on the rotating shaft 410 to be spaced at regular intervals from each other, such that the same pressing force is distributed in the first direction W1, and thus the developing unit 1041 is pressed by an uniform pressing force, regardless of a position in a lengthwise direction thereof.

The pressing unit 420 may be provided to be moved between a pressing position P1 in which the developing roller 1042 and the photoreceptor 1052 come into contact with each other, and a releasing position P2 which is moved backed from the pressing position P1 so that the developing roller 1042 and the photoreceptor 1052 are separated from each other. Specifically, when the pressing unit 420 is at the pressing position P1, the developing unit 1041 is pressed by the pressing unit 420, and thus the developing roller 1042 and the photoreceptor 1052 come into contact with each other. Also, when the pressing unit 420 is at the releasing position P2, the pressing of the pressing unit 420 with respect to the developing unit 1041 is released, and thus the developing roller 1042 and the photoreceptor 1052 are separated from each other.

The operating unit 450 may be rotatably provided so that the pressing unit 420 is operated by the operation of the operating unit 450. That is, at least one pressing unit 420 may be provided to be interlocked with the operating unit 450.

The operating unit 450 may include an operating body 453 which is connected with the rotating shaft 410 so as to be rotated about the rotating shaft 410.

The operating unit 450 may be provided to be movable between an operating position 01 in which a pressing force is generated from the pressing unit 420 and a stand-by position 02 in which the pressing force is released.

When the operating unit 450 is at the operating position 01, the pressing unit 420 presses the developing unit 1041, and when the operating unit 450 is at the stand-by position 02, the pressing of the pressing unit 420 with respect to the developing unit 1041 is released.

The pressing unit 420 may include a pressing part 440 and a direction control part 430.

The pressing part 440 may be provided to generate a pressing force, and the direction control part 430 may be provided to change a direction of the pressing force of the pressing part 440.

The pressing part 440 may include a pressing body 442 and a pressing elastic member 446.

The pressing body 442 may be provided to press the developing unit 1041. The pressing body 442 may be disposed perpendicular to a lengthwise direction of the rotating shaft 410. A pressing surface 442*a* is provided at a front portion of the pressing body 442. The pressing surface 442*a* may be provided to come into direct contact with the developing unit 1041 and thus to press the developing unit 1041.

The pressing body 442 may be provided so that the rotating shaft 410 passes through one side thereof. Specifically, the pressing body 442 has a through-hole 442*b* through which the rotating shaft 410 passes, and is provided to be rotated separately from the rotating shaft 410.

The pressing elastic member 446 is provided to provide an elastic force to the pressing body 442 and thus to press the developing unit 1041. One end of the pressing elastic member 446 supports an inner side surface of the pressing body 442, and the other end thereof supports the rotating shaft 410 in a direction perpendicular to the lengthwise direction of the rotating shaft 410.

Both side surfaces of the pressing body 442 are opened, and the pressing body 442 is provided to be moved in the direction perpendicular to the lengthwise direction of the rotating shaft 410. Specifically, a pressing space 443 in which the pressing elastic member 446 is disposed and an available space 444 which is varied according to an extension and compression of the pressing elastic member 446 are formed at an inner side of the pressing body 442. That is, when the pressing elastic member 446 is compressed, the pressing space 443 is reduced, and the available space 444 is increased, and when the pressing elastic member 446 is restored, the pressing space 443 is increased, and the available space 444 is reduced.

The direction control part 430 is provided to control a direction of the pressing part 440 depending on a rotation of the rotating shaft 410.

The direction control part 430 is formed to extend perpendicular to an axial direction from the rotating shaft 410 and also to be rotated along with the rotation of the rotating shaft 410. The direction control part 430 may be integrally formed with the rotating shaft 410, or may be formed to be vertically inserted into the rotating shaft 410.

The direction control part 430 may include a direction guide part 448 guiding a direction of the pressing part 440.

The direction guide part 448 serves as a medium between the pressing body 442 and the direction control part 430. A change of a position of the direction control part 430 is transmitted to the pressing body 442 so as to change the direction of the pressing force of the pressing body 442.

The direction guide part 448 is provided to cover at least a part of the pressing body 442. The direction guide part 448 may include a direction guide surface 448*a* of which a direction is guided by the direction control part 430. One pair of direction guide surfaces 448*a* may be provided in a circumferential direction of the rotating shaft 410 with respect to the direction control part 430. An insertion space 448*b* in which the direction control part 430 is inserted is formed between the one pair of direction guide surfaces 448*a*. Through such a structure, when the direction control part 430 is rotated by the rotation of the rotating shaft 410, one of the pair of direction guide surfaces 448*a* is guided, and the pressing part 440 may be rotated also.

The operating unit 450 may include a rotating body 451, and an operating member 452 which operates the rotating body 451.

The rotating body 451 is provided to be rotated along with the rotating shaft 410, and the operating member 452 is provided to be rotatable with respect to the rotating shaft 410 and thus to rotate the rotating body 451.

The rotating body 451 may be provided at an end of the rotating shaft 410 to be rotated along with the rotating shaft 410. The rotating body 451 may be provided to protrude perpendicular to the axial direction of the rotating shaft 410.

A fastening member 451*a* may be provided at the rotating body 451 so that the rotating body 451 and the rotating shaft 410 are rotated together.

The operating member 452 may be provided to rotate the rotating body 451.

The operating member 452 may include the operating body 453, a unit pressing part 454, and a rotation guide part 456.

The operating body 453 is disposed perpendicular to the rotating shaft 410 and adjacent to the rotating body 451. The operating body 453 may be integrally formed with the rotating shaft 410 to be rotated along with the rotation of the rotating shaft 410. However, in an embodiment, the operating body 453 may be provided to guide the rotation of the rotating body 451, such that the rotating shaft 410 integrally formed with the rotating body 451 is also rotated together. That is, the operating body 453 may be rotated separately from the rotating shaft 410, and may have a hole through which the rotating shaft 410 passes.

In regard to a cover unit 470 which will be described below, the operating body 453 may be provided so that whether or not the cover unit 470 may be installed is determined according to a pressed state of the developing unit 1041.

The unit pressing part 454 may be provided on the operating body 453 so as to press the photoreceptor unit 1050. Specifically, the unit pressing part 454 may be disposed at an end of the operating body 453, and when the operating unit 450 is at the operating position 01, the unit pressing part 454 presses the photoreceptor unit 1050. The unit pressing part 454 may be is formed to protrude more than the adjacent operating body 453, and a unit to-be-pressed part 1058 which is formed to be concave corresponding to the pressing part 440 is disposed at the photoreceptor unit 1050. By seating the unit pressing part 454 on the unit to-be-pressed part 1058, the photoreceptor unit 1050 is prevented from being separated in the separating direction W1*b*.

The rotation guide part 456 may be disposed at the operating body 453 in a direction of the rotating center thereof so as to guide the rotation of the rotating body 451. The rotation guide part 456 and the rotating body 451 are spaced apart a predetermined distance, and when the operating body 453 is rotated at a predetermined angle, the rotation guide part 456 and the rotating body 451 come into contact with each other, and thus the rotating force is transmitted. Therefore, an actual rotating angle of the rotating body 451 is greater than a rotating angle of the operating body 453. As the rotating angle of the operating body 453 is increased, a risk of malfunction in a structure which is interlocked with whether or not the cover unit 470 may be installed is reduced. The distance between the rotation guide part 456 and the rotating body 451 is not limited, and may be varied according to various factors such as a size of the image forming apparatus and an arrangement of the developing device 1040.

The rotation guide part 456 may include an operating rotation guide part 456*a* and a stand-by rotation guide part 456*b*.

When the operating unit 450 is moved from the stand-by position 02 to the operating position 01, the operating rotation guide part 456*a* presses the rotating body 451, and thus the pressing unit 420 is moved to the pressing position P1. Contrarily, when the operating unit 450 is moved from the operating position 01 to the stand-by position 02, the stand-by rotation guide part 456*b* presses reversely the rotating body 451, and thus the pressing unit 420 is moved to the releasing position P2. One pair of the operating rotation guide part 456*a* and the stand-by rotation guide part 456*b* may be provided within a rotational radius of the rotating body 451 on the operating body 453.

The cover unit 470 may be detachably provided at one side of the developing device 1040. Whether or not the cover unit 470 may be installed may be determined according to a position of the operating unit 450. Specifically, the cover unit 470 may be installed only when the operating unit 450 is at the operating position 01.

The cover unit 470 may include a cover body 472 and an operating insertion part 474.

The cover body 472 may be provided to cover one side of the developing device 1040, and may be provided to be connected with the developing device 1040 and thus to store waste toner generated from the developing device 1040.

The operating insertion part 474 may be formed to be concave from the cover body 372 so that the operating body 453 of the operating unit 450 is inserted therein. The operating body 453 may be inserted into the operating insertion part 474, only when the operating unit 450 is at the operating position 01. That is, only when the operating unit 450 is at the operating position 01, and the pressing unit 420 is at the pressing position P1, the operating body 453 may be inserted into the operating insertion part 474. The operating insertion part 474 is provided to correspond to the operating body 453, such that the operating body 453 is inserted therein, only when the operating unit 450 is at the operating position 01.

The operating insertion part 474 may be more concave than the adjacent cover body 472. When the operating unit 450 is at another position other than the operating position 01, the cover body 372 interferes with the operating body 453, and the cover unit 470 may not be installed at the developing device 1040.

Hereinafter, an operation of the image forming apparatus in accordance with an embodiment of the disclosure will be described.

Figure 27A:
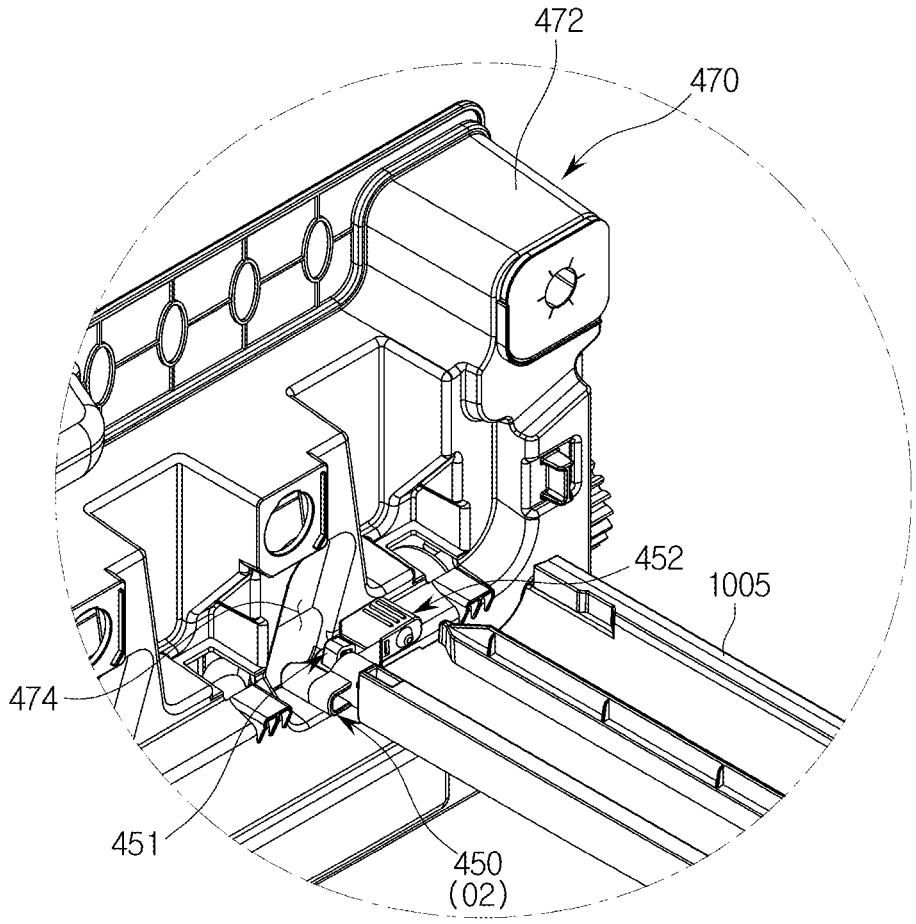
FIGS. 27A and 27B are views illustrating the developing device of the cover unit depending on the operation of the pressing assembly in accordance with an embodiment of the disclosure.
Figure 27B:
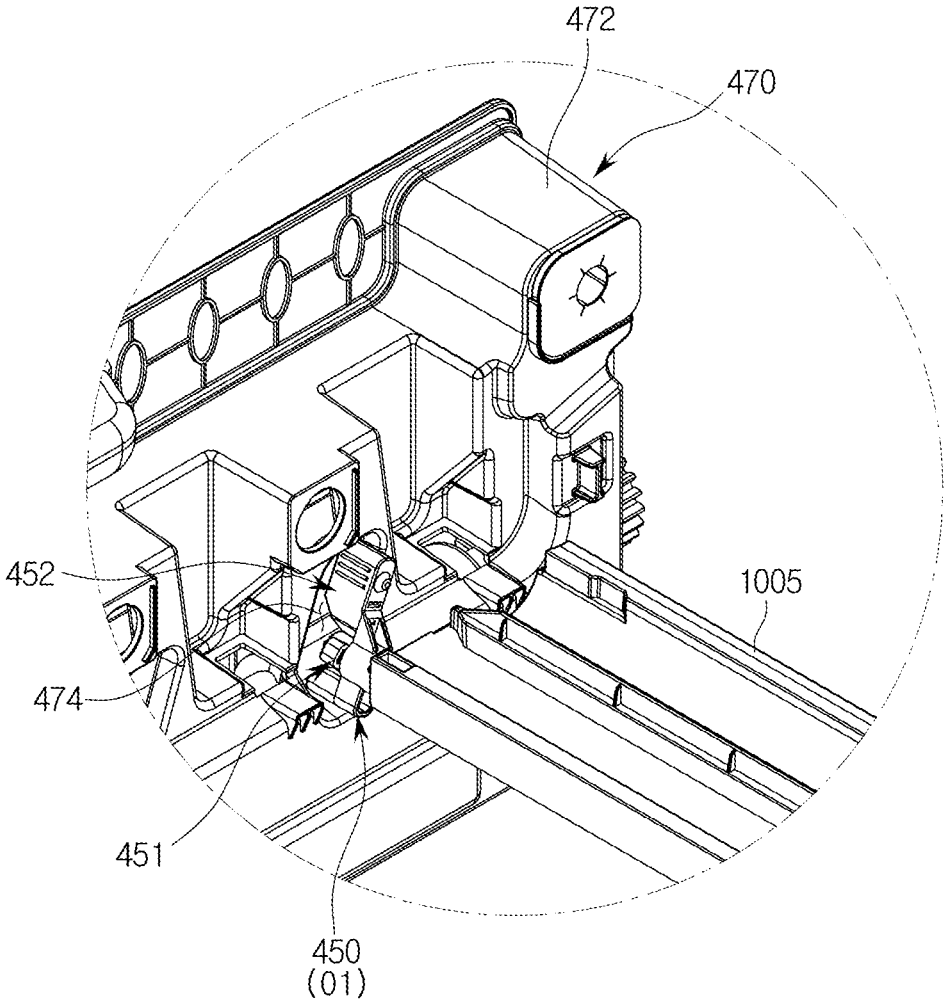

FIGS. 27A and 27B are views illustrating the developing device of the cover unit depending on the operation of the pressing assembly in accordance with an embodiment of the disclosure.

To perform a printing operation after the developing device 1040 is seated on the developing device seating part 1005, the developing unit 1041 and the photoreceptor unit 1050 should come into close contact with each other so that the developing roller 1042 and the photoreceptor 1053 come into contact with each other.

The pressing assembly 400 is operated so that the developing unit 1041 and the photoreceptor unit 1050 should come into close contact with each other.

In the initial stage, the operating unit 450 is at the stand-by position 02, and when the developing device 1040 is seated on the developing device seating part 1005, the operating unit 450 is rotated so that the pressing unit 420 presses the developing unit 1041.

The operating body 453 is rotated so as to rotate the operating unit 450 from the stand-by position 02 to the operating position 01. Due to the rotation of the operating body 453, the operating rotation guide part 456*a* of the rotation guide part 456 of the operating body 453 presses the rotating body 451, and thus the rotating body 451 and the rotating shaft 410 are rotated. The rotating shaft 410 is rotated along with the direction control part 430 of the pressing unit 420. Through such an operation, the direction of the pressing force generated from the pressing part 440 is controlled, and the developing unit 1041 is pressed. That is, the pressing unit 420 is moved to the pressing position P1.

When the operating unit 450 is at the operating position 01, the unit pressing part 454 of the operating body 453 is seated on the unit to-be-pressed part 1058 of the photoreceptor unit 1050 to prevent the photoreceptor unit 1050 from being separated. When the operating unit 450 is at the operating position 01, the operating body 453 may be inserted into the operating insertion part 474 of the cover unit 470, and thus the cover unit 470 may be installed at the developing device 1040.

To rotate the operating unit 450 from the operating position 01 to the stand-by position 02, the operating body 453 is rotated reversely. Due to the rotation of the operating body 453, the stand-by rotation guide part 456*b* of the rotation guide part 456 of the operating body 453 presses reversely the rotating body 451, and thus the rotating body 451 and the rotating shaft 410 are rotated. The rotating shaft 410 is rotated along with the direction control part 430 of the pressing unit 420. Through such an operation, the direction of the pressing force generated from the pressing part 440 is controlled, and the pressing to the developing unit 1041 is released. That is, the pressing unit 420 is moved to the releasing position P2.

When the operating unit is at the stand-by position 02, the unit pressing part 454 of the operating body 453 is separated from the to-be-pressed surface 1056 of the photoreceptor unit 1050, and the developing device 1040 is in a state to be separable from the developing device seating part 1005. When the operating unit is at the stand-by position 02, the cover body 472 interferes with the operating body 453, and thus the cover unit 470 may not be installed at the developing device 1040. Therefore, the image forming apparatus is operated, even though the developing roller 1042 and the photoreceptor 1052 are separated, and thus the malfunction or damage of the image forming apparatus may be prevented. That is, whether the image forming apparatus may be operated may be determined by whether or not the cover unit 470 may be installed, and thus the malfunction or the damage may be prevented beforehand.

According to the image forming apparatus of the disclosure, the fixing structure of the developing unit is improved, and thus the developing unit may be effectively installed in the main body.

Also, the pressing structure of the developing unit is improved, and thus a defective image may be prevented from being formed even when the external impact is applied.

Although example embodiments of the disclosure have been shown and described, it would be appreciated by those skilled in the art that changes may be made to these embodiments without departing from the principles and spirit of the disclosure, the scope of which is defined in the claims and their equivalents.

Also, each embodiment may be applied complementarily. For example, the operating unit of the image forming apparatus in accordance with any embodiment of the disclosure may be applied to that in accordance with any other embodiment of the disclosure, and the shutter unit of the image forming apparatus in accordance with any embodiment of the disclosure may be applied to that in accordance with any other embodiment of the disclosure.

What is claimed is:

1. An image forming apparatus comprising:

a main body;

a developing device elongated in a first direction, and comprising a photoreceptor unit having a photoreceptor, and a developing unit provided adjacent to the photoreceptor and having a developing roller provided to come into contact with or be separated from the photoreceptor; and a pressing assembly provided adjacent to the developing device and configured to press the developing device so that the developing roller and the photoreceptor come into contact with each other, comprising:

a rotating shaft formed to extend in the first direction, and an operating unit provided at an end of the rotating shaft to be rotated along with the rotating shaft and configured to restrict movement of the developing device in the first direction.

2. The apparatus according to claim 1, wherein the operating unit is provided to be rotatable from a stand-by position to an operating position to support an end of the developing device to restrict movement of the developing device in the first direction.

3. The apparatus according to claim 2, wherein the operating unit comprises an operating body rotatably provided at an end of the rotating shaft, and a pressing member provided at one side of the operating body to press the developing device.

4. The apparatus according to claim 3, wherein the pressing member is formed to be more convex than the operating body.

5. The apparatus according to claim 3, wherein the first direction comprises an installing direction in which the photoreceptor unit is installed at a developing device seating part, and a separating direction which is opposite to the installing direction and in which the photoreceptor unit is separated from the developing device seating part, and the pressing member comprises a first pressing part in which the operating unit comes into contact with the developing device while moved from the stand-by position to the operating position, and a second pressing part which extends from the first pressing part so as to protrude more in the installing direction than the first pressing part, the operating unit coming in contact with the developing device at the operating position.

6. The apparatus according to claim 2, wherein the first direction comprises an installing direction in which the photoreceptor unit is installed at a developing device seating part, and a separating direction which is opposite to the installing direction and in which the photoreceptor unit is separated from the developing device seating part, and the photoreceptor unit comprises a to-be-pressed surface formed to be inclined, such that the photoreceptor unit is pressed in the installing direction by the operating unit while the operating unit is moved from the stand-by position to the operating position.

7. The apparatus according to claim 1, wherein a movement of the rotating shaft in the first direction is restricted by a developing device seating part.

8. The apparatus according to claim 3, wherein the first direction comprises an installing direction in which the photoreceptor unit is installed at a developing device seating part, and a separating direction which is opposite to the installing direction and in which the photoreceptor unit is separated from the developing device seating part, and the operating unit further comprises an operation elastic part configured to press the operating body in the installing direction.

9. The apparatus according to claim 8, wherein the operation elastic part comprises a fastening member provided at one end of the rotating shaft to have a component vertical to a rotating axis of the rotating shaft, and an installation elastic member of which one end is supported by the fastening member, and the other end presses the operating unit in the installing direction.

10. The apparatus according to claim 9, wherein the operating unit is pressed in the installing direction by the installation elastic member, and a movement of the operating unit in the separating direction is restricted by the fastening member.

11. The apparatus according to claim 9, wherein the operating unit further comprises an installing space formed at an inner side of the operating body so that the operation elastic part is installed therein, and the installing space comprises a first installing space in which the installation elastic member is installed to extend or be compressed, and a second installing space which is formed using a movement restricting surface configured to restrict a movement of the operating unit in the separating direction and in which the fastening member is installed.

12. The apparatus according to claim 2, wherein the pressing assembly further comprises at least one pressing unit configured to be interlocked with the operating unit and to press the developing unit so that the developing roller and the photoreceptor come into close contact with each other.

13. The apparatus according to claim 12, wherein the operating unit presses the photoreceptor unit in the first direction while moved from the stand-by position to the operating position, and the at least one pressing unit is interlocked with the movement of the operating unit from the stand-by position to the operating position, and presses the developing unit in a second direction vertical to the first direction.

14. The apparatus according to claim 12, wherein the at least one pressing unit comprises a link unit configured to convert rotating motion of the rotating shaft caused by rotation of the operating unit into linear reciprocating motion, and a pressing part connected with the link unit so as to press the developing device.

15. The apparatus according to claim 14, wherein the link unit comprises a first link member rotated along with the rotating shaft, and a second link member of which one end is connected with an end of the first link member and the other end linearly reciprocates.

16. The apparatus according to claim 12, wherein the at least one pressing unit comprises a plurality of pressing units disposed at the rotating shaft spaced apart from each other.

17. The apparatus according to claim 15, wherein the link unit comprises a pressing elastic member provided at the second link member to generate a pressing force of the pressing unit.

18. The apparatus according to claim 17, wherein the second link member comprises a stopper insertion part of which at least a part is inserted into the pressing part depending on a position of the pressing unit, and a variable seating part which is disposed adjacent to the stopper insertion part, and in which the pressing elastic member is seated thereon, and a length of the pressing elastic member is varied so that the pressing force of the pressing elastic member is varied.

19. The apparatus according to claim 17, wherein one end of the pressing elastic member is supported by an end of the second link member, and the other end thereof is supported by the pressing part.

20. The apparatus according to claim 17, wherein the pressing elastic member is compressed to a maximally compressed length when the operating unit is disposed between the operating position and the stand-by position.

21. An image forming apparatus comprising:

a main body;

a developing device comprising a photoreceptor unit having a photoreceptor, and a developing unit provided adjacent to the photoreceptor and having a developing roller provided to come into contact with or be separated from the photoreceptor; and a pressing assembly provided adjacent to the developing device comprising:

a pressing unit configured to press the developing unit so that the developing roller and the photoreceptor come into contact with each other, and an operating unit provided to restrict movement of the developing device and to be moved between an operating position in which a pressing force is generated from the pressing unit and a stand-by position in which the pressing force is released.

22. The apparatus according to claim 21, wherein a first direction is a lengthwise direction of the developing device, the operating unit presses the developing device in the first direction, and the pressing unit presses the developing unit in a second direction vertical to the first direction.

23. The apparatus according to claim 22, wherein a pressing operation of the operating unit in the first direction with respect to the developing device, and a pressing operation of the pressing unit in the second direction with respect to the developing unit are performed simultaneously.

24. The apparatus according to claim 22, wherein the operating unit comprises an operating body rotatably provided at an end of a rotating shaft, and a pressing member provided at one side of the operating body to press the developing device.

25. The apparatus according to claim 24, wherein the pressing member is formed to be more convex than the adjacent operating body.

26. The apparatus according to claim 24, wherein the first direction comprises an installing direction in which the photoreceptor unit is installed at a developing device seating part, and a separating direction which is opposite to the installing direction and in which the photoreceptor unit is separated from the developing device seating part, and the pressing member comprises a first pressing part in which the operating unit comes into contact with the developing device while moved from the stand-by position to the operating position, and a second pressing part which extends from the first pressing part so as to protrude more in the installing direction than the first pressing part, the operating unit coming in contact with the developing device at the operating position.

27. The apparatus according to claim 22, wherein the first direction comprises an installing direction in which the photoreceptor unit is installed at a developing device seating part, and a separating direction which is opposite to the installing direction and in which the photoreceptor unit is separated from the developing device seating part, and the photoreceptor unit comprises a to-be-pressed surface formed to be inclined, such that the photoreceptor unit is pressed in the installing direction by the operating unit while the operating unit is moved from the stand-by position to the operating position.

28. The apparatus according to claim 22, wherein the pressing assembly further comprises a rotating shaft configured to extend in the first direction so as to transmit an operation of the operating unit to the pressing unit.

29. The apparatus according to claim 28, wherein a movement of the rotating shaft in the first direction is restricted by a developing device seating part.

30. The apparatus according to claim 22, wherein the first direction comprises an installing direction in which the photoreceptor unit is installed at a developing device seating part, and a separating direction which is opposite to the installing direction and in which the photoreceptor unit is separated from the developing device seating part, and the operation unit further comprises an operating elastic part configured to press the operating body in the installing direction.

31. The apparatus according to claim 28, wherein the operation elastic part comprises a fastening member provided at one end of a rotating shaft to have a component vertical to a rotating axis of the rotating shaft, and an installation elastic member of which one end is supported by the fastening member, and the other end presses the operating unit in the installing direction.

32. The apparatus according to claim 31, wherein the operating unit is pressed in the installing direction by the installation elastic member, and a movement of the operating unit in the separating direction is restricted by the fastening member.

33. The apparatus according to claim 24, wherein the operating unit further comprises an installing space formed at an inner side of the operating body in which an elastic member is installed, and the installing space comprises a first installing space in which the elastic member is installed to extend or be compressed, and a second installing space which is formed using a movement restricting surface configured to restrict a movement of the operating unit in the separating direction and in which a fastening member is installed.

34. An image forming apparatus comprising:

a main body;

a developing device comprising a photoreceptor and a developing roller; and a pressing assembly comprising:

a rotating shaft, an operating unit provided on the rotating shaft to rotate between a standby position and an operating position based on rotation of the rotating shaft, and a pressing unit provided on the rotating shaft to move in a first direction, which is substantially perpendicular to an axial direction of the rotating shaft, when the operating unit is rotated from the standby position to the operating position, and to press the developing unit to cause the developing roller and the photoreceptor to come into contact with each other when the pressing unit moves in the first direction.

35. The apparatus according to claim 34, wherein the photoreceptor is included in a photoreceptor unit and the developing roller is included in a developing unit, the operating unit comprises an operating body and a pressing member provided at one side of the operating body, and when the operating unit rotates from the standby position to the operating position the pressing member contacts the photoreceptor unit to press the photoreceptor in the axial direction.

36. The apparatus according to claim 35, further comprising:

an optical scanning unit disposed adjacent to the developing device to radiate light through an optical window onto the photoreceptor, and a shutter unit to open and close the optical window, wherein the pressing unit comprises:

a pressing part comprising a pressing body, a pressing surface disposed at a front side of the pressing part to press the developing unit toward the photoreceptor unit when the operating unit is rotated from the standby position to the operating position, and a shutter guide member disposed on a side surface of the pressing body to guide an operation of the shutter unit so as to open and close the optical window.

37. The apparatus according to claim 36, wherein when the pressing surface presses the developing unit toward the photoreceptor unit when the operating unit is rotated from the standby position to the operating position, the shutter guide member is configured to press a shutter protrusion of the shutter unit so as to open the optical window at a same time as when the pressing unit causes the developing roller and the photoreceptor to come into contact with each other.

* * * * *